US008307690B2

(12) United States Patent
Cobzaru

(10) Patent No.: US 8,307,690 B2
(45) Date of Patent: Nov. 13, 2012

(54) HAND-TOOL SYSTEM FOR INSTALLING BLIND FASTENERS

(75) Inventor: Cristinel Ovidiu Cobzaru, Murrieta, CA (US)

(73) Assignee: SPS Technologies, LLC, Jenkintown, PA (US)

( * ) Notice: Subject to any disclaimer, the term of this patent is extended or adjusted under 35 U.S.C. 154(b) by 141 days.

(21) Appl. No.: 12/871,534

(22) Filed: Aug. 30, 2010

(65) Prior Publication Data

US 2011/0048099 A1 Mar. 3, 2011

Related U.S. Application Data

(60) Provisional application No. 61/237,979, filed on Aug. 28, 2009.

(51) Int. Cl.
*B21J 15/20* (2006.01)

(52) U.S. Cl. ..... 72/453.17

(58) Field of Classification Search ..... 72/391.8, 72/453.15, 453.16, 453.17; 29/524.1, 525.06, 29/243.523, 243.527
See application file for complete search history.

(56) References Cited

U.S. PATENT DOCUMENTS 3,886,782 A 6/1975 Miyamoto
4,263,801 A 4/1981 Gregory
4,353,239 A 10/1982 Fujimoto
4,515,005 A * 5/1985 Klein ..... 29/243.525
4,587,829 A * 5/1986 Sukharevsky ..... 29/243.522
4,628,722 A * 12/1986 Mauer et al. ..... 29/812.5
5,323,521 A 6/1994 Freund et al.
5,425,164 A 6/1995 El Dessouky
5,437,085 A 8/1995 Liu
6,065,326 A * 5/2000 Frenken ..... 72/453.15
6,115,900 A 9/2000 Cerulo et al.
6,532,635 B1 * 3/2003 Gregory ..... 29/243.523
6,651,301 B1 11/2003 Liu
6,684,679 B2 * 2/2004 Hsieh ..... 72/453.15
7,146,698 B2 12/2006 Kovar
7,159,290 B1 * 1/2007 Liu ..... 29/243.523
7,243,525 B2 7/2007 Galluzo

* cited by examiner

*Primary Examiner* — Faye Francis
(74) *Attorney, Agent, or Firm* — Clark Hill PLC

(57) ABSTRACT

A tool for setting blind fasteners is disclosed. A stem of a fastener is engaged by a pulling head and its sleeve is also engaged by the pulling head. In an initial stage, a pump piston compresses fluid in a hydraulic pump, affecting movement of a drawbar and piston in relation to a stationary adaptor connected to the tool, pulling the stem in relation to the sleeve at a fast rate per pump. As the pulling force increases, pressure in the pump triggers a logic system to shift the tool into a high pressure mode, decreasing the effort to complete fastener installation. The logic system resets after each squeeze of the lever, minimizing the number of pumps necessary to complete the installation while keeping effort at a comfortable level. An adjustable pressure relief valve allows the fluid to return to the reservoir chamber, returning the tool to its initial condition.

20 Claims, 25 Drawing Sheets

HAND-TOOL SYSTEM FOR INSTALLING BLIND FASTENERS

CROSS-REFERENCE AND INCORPORATION BY REFERENCE

This patent application claims the benefit of domestic priority of U.S. Provisional Application Ser. No. 61/237,979, filed Aug. 28, 2009, and entitled "Hand-Tool System for Installing Blind Fasteners". U.S. Provisional Application Ser. No. 61/237,979 is hereby incorporated by reference.

FIELD OF THE INVENTION

This disclosure relates to tools used for, but not limited to, the installation of fasteners which are accessible from only one side, often called blind rivets. More specifically, the disclosure relates to a lightweight and compact hand-operated tool which uses a hydraulically powered piston to pull the stem of a blind rivet through a sleeve, whereby the fastener is set in a work-piece.

BACKGROUND OF THE INVENTION

Blind rivets or fasteners are of the type used when only one side of the work-piece is accessible. In such fasteners, a stem and a sleeve are inserted as a unit into aligned openings in work-pieces. The sleeve typically has a tail which engages the blind side of the work-pieces and a head which engages the side of the work-pieces which is accessible. A stem tail extending beyond the sleeve head is pulled from the accessible side of the sleeve causing a head on the stem, protruding beyond the sleeve tail to be drawn against the sleeve tail to deform it and fasten them together by either flaring the sleeve into the holes through the work-pieces, or creating a bulb on the blind side of the work-pieces, or a combination of the two. Once the sleeve has deformed, the work-pieces stay secured together, sandwiched between the head of the sleeve on the accessible side of the work-pieces and the sleeve deformation within the holes and on the blind side of the work-pieces. At the completion of fastener installation, the stem tail typically breaks at a predetermined location near the head of the sleeve, allowing for removal of the excess stem portion protruding from the sleeve.

Many types of tools have been developed prior to this time for installing blind fasteners of the types described above. These tools have included pneumatic-hydraulic and hydraulically powered tools which use a piston to pull the stem of the fastener.

Many of these tools have suffered from the limitation that they required a source of hydraulic or pneumatic pressure to power the piston. Such a requirement adds to the cost and complexity of such equipment. Further, when a hydraulic or pneumatic pressure source is required, the tool is not portable and its use is limited only to locations where the power source is available. Furthermore, the requirement to attach a hydraulic or pneumatic source to the tool with hoses and cords prevents the tool from being used in many difficult to reach area.

More commonly, the power source is not even available in repair situations. For this type of applications, several hand powered tools have been developed. These tools typically use a hydraulically operated piston to pull the rivet stem but unlike the tools described above using hoses and cords, they utilize the operator's hand strength squeezing a lever to create the hydraulic pressure necessary to install the fastener.

One such hand operated tool is disclosed in U.S. Pat. No. 4,263,801 to Gregory which describes a relatively light and compact hydraulic hand operated riveter. This tool achieves the output force by a combination of long levers used for pumping, and a small hydraulic pump. The fluid pressure causes the piston to move away from the nose piece, which is fixed to the cylinder and engages the sleeve. As pressure in the pressure chamber increases, the piston is forced away from nose piece, at the same time pulling the stem through the sleeve and completing fastener installation.

This riveter, however, has a number of significant shortcomings, including, but not necessarily limited to, the following. First, these tools have been often bulky and heavy in comparison to their modest load capability. Second the force necessary to squeeze the lever in order to generate hydraulic pressure is often so high that it is not possible for an average person to operate the tool towards the high end of its capability, and if they do, the strain on the hand and fatigue will potentially cause the operator to stop, work very slow or even cause hand injuries. Third, the tool has low productivity as it takes a considerable amount of pumps to complete a fastener installation.

In addition to the above mentioned shortcomings, it has a narrow field of application, as it is generally dedicated to certain types of fasteners.

Another such hand operated tool is disclosed in U.S. Pat. No. 5,425,164 to El Dessouky. This tool was developed in order to overcome some of the shortcomings of the Gregory tool, and was a big improvement when first introduced.

In an initial stage, a pump plunger compresses fluid in first and second chambers into a piston chamber, causing rapid movement of the housing and drawbolt in relation to the piston, pulling the stem of a fastener in relation to its sleeve.

As the pulling force increases, and thus the necessary hand pumping force, pressure in the piston chamber opens a valve allowing the fluid in the first chamber to return to the reservoir so that only the second plunger chamber is used to compress fluid into the pressure chamber, lessening the force necessary to pump the lever.

This riveter has a number of shortcomings, as briefly stated below.

First, the tool takes too much effort to operate, which leads to rapid operator fatigue. Second, the tool has a relatively narrow field of application and pulling head change over or service is relatively difficult and time consuming. Third, the tool is very complex, hard to troubleshoot or service. Furthermore, since this tool's introduction, the ergonomic, operation and serviceability requirements for this type of tool have become more demanding, manufacturing costs have increased and newer aircraft have used stronger and more diverse fasteners requiring more installation load and versatility.

Prior art fastener setting tools thus are not fulfilling the current expectations for high productivity, versatility, simple troubleshooting and service, minimized environmental impact and advanced ergonomics like low hand effort, soft, insulated handles and adjustable tool configuration to mach the operator's hand size and strength.

SUMMARY OF THE INVENTION

In order to overcome the stated problems and provide a tool that meets the current expectation, there is provided an improved hand operated hydraulically powered tool for installing blind fasteners. In general, the tool comprises a stationary housing with an internally threaded adaptor and a moveable externally threaded piston rod. Any type of suitable pulling heads may be easily mounted to the threaded end of the tool, making the tool very versatile. Although not the subject of this invention, the pulling head used with this tool is comprised by a stationary sleeve threaded into the adaptor, having a nose-piece appropriate to the fastener to be installed and a drawbar with stem gripping means threaded onto the moveable piston rod. To pull the fastener stem through the sleeve in order to complete its installation, pressurized fluid is sent to a piston pressure chamber causing the piston to retract in relation to the housing and adaptor. Pressure is created by squeezing a lever towards the tool handle multiple times until the fastener installation is completed. The tool is operated initially in a low pressure mode, at which a rapid retraction of the piston is assured with each pump. During this stage, a faster piston travel ensures a minimum number of pumps (squeezes) for a desired piston travel. Also, a lower level of pressure is established in the piston chamber, developing a relatively low force output. The hand effort increases as the fastener installation load increases but it is limited at a comfortable level by shifting to a high pressure mode when the hand effort reaches a certain level. The high pressure mode reduces the hand effort roughly by a factor of three. More specifically, at a certain internal pressure, a signal triggers a logical system to pressurize both sides of the pump piston to assist the operator while pumping. Obviously, since some of the pumped fluid is used to reduce hand effort, a lower amount of fluid will be pumped into the piston pressure chamber, slowing down the travel of the piston. The tool operation is optimized by continuously shifting between a low pressure and a high pressure mode to provide high output load at low hand effort and with a reduced number of squeezes. Once the stem has been pulled to the point at which the fastener has been set and the stem has broken off, a manual relief means may be operated for relieving the pressure in the tool to prepare it for setting another fastener. The manual relief means also provide adjustable and automatic safety pressure relief once the internal pressure reaches a preset level. This pressure relief means includes a bypass valve which opens to allow the fluid to return to the reservoir. In a preferred embodiment, the pump lever and the pressure relief are adjustable, and the fluid level in the system is easily monitored to assist the operator in servicing the tool. These and other aspects of the invention will become apparent from a study of the following description which reference is directed to the following drawings.

BRIEF DESCRIPTION OF THE DRAWINGS

For a more complete understanding of the disclosure, reference may be made to the following detailed description and accompanying drawings wherein like reference numerals identify like elements in which.

DETAILED DESCRIPTION OF THE ILLUSTRATED EMBODIMENTS

Figure 1:
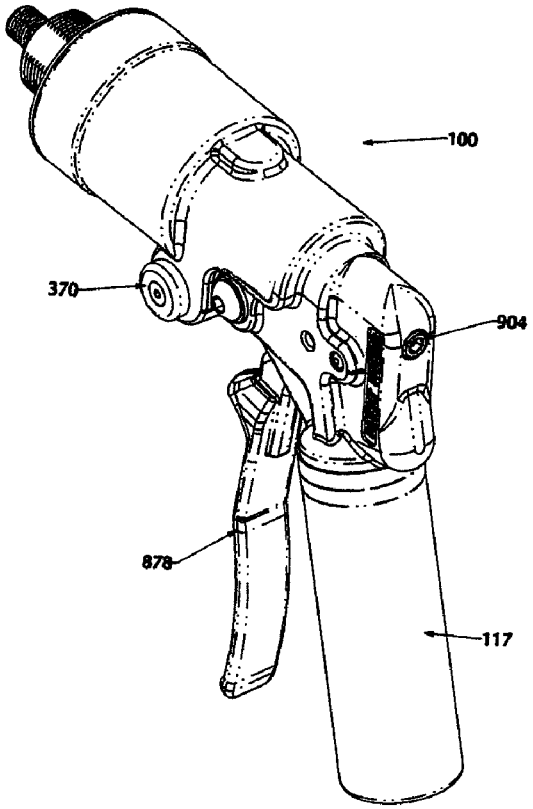
FIG. 1 is a perspective view of an embodiment of a tool of the invention.

While the present disclosure is susceptible to various modifications and alternative forms, certain embodiments are shown by way of example in the drawings and these embodiments will be described in detail herein. It will be understood, however, that this disclosure is not intended to limit the invention to the particular form described, but to the contrary, the invention is intended to cover all modifications, alternatives, and equivalents falling within the spirit and scope of the invention defined by the appended claims.

Figure 5A:
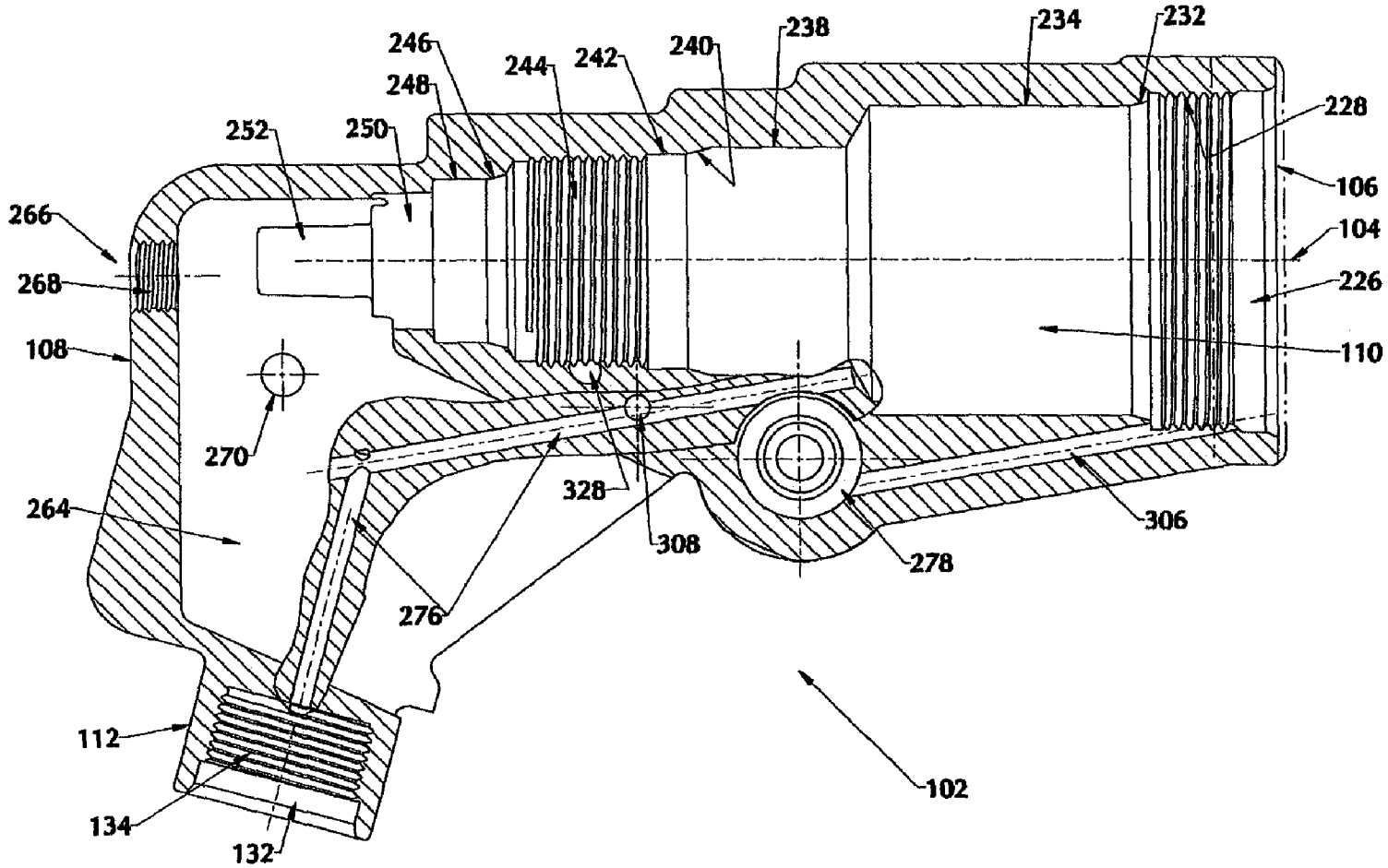
FIG. 5*a* is a cross sectional view of the housing 102 along section plane 4-4, with a partial section along line 5-5 showing the relief fluid pathway.

An embodiment of a hand operated tool 100 is best illustrated in the drawings. As best illustrated in FIG. 5*a*, the tool 100 includes a housing 102 having a centerline 104, a forward open end 106 and a rear closed end 108. Preferably, the housing 102 is constructed of cast aluminum. A recess 110 extends inwardly from the open end 106 toward the closed end 108 along the centerline 104.

In the description of the structure of the tool 100, the terms "tapers" and "angles" are used to describe the configuration of portions of the tool 100. The term "taper(s)" is used to describe that a diameter of the portion of the tool 100 is becoming smaller in the context provided, while the term "angle(s)" is used to describe that a diameter of the portion of the tool 100 is becoming larger in the context provided. For instance, the phrase "a second inner diameter portion tapers from the first inner diameter portion to a third inner diameter portion" indicates that a diameter at the connection of the first and second inner diameter portions is larger than a diameter at the connection of the second and third inner diameter portions. Conversely, for instance, the phrase "a second inner diameter portion angles from the first inner diameter portion to a third inner diameter portion" indicates that a diameter at the connection of the first and second inner diameter portions is smaller than a diameter at the connection of the second and third inner diameter portions. The term "extend(s)" is used herein to indicate no change in diameter between different portions of the tool 100 described. Regardless of the foregoing, the drawings provided are accurate in the event that there is a discrepancy between the drawing and the description of the drawing.

The recess 110 of the housing 102 will be described with reference to FIG. 5*a*. The recess 110 defines a plurality of inner diameter portions 226, 228, 234, 238, 242, 244, 248, 250, 252 of the housing 102. A first inner diameter portion 226 extends inwardly from the forward open end 106 of the housing 102 to a second inner diameter portion 228, which is preferably threaded. The second inner diameter portion 228 extends inwardly to a third inner diameter portion 234 through a tapered surface 232. The third inner diameter portion 234, in turn, extends inwardly to a smaller fourth inner diameter portion 238 which, in turn, extends inwardly to a fifth inner diameter portion 242 with a tapered transition 240. The fifth inner diameter portion 242 extends inwardly to a sixth inner diameter portion 244, which is preferably threaded, which, in turn, extends to a seventh inner diameter portion 248 with a tapered transition 246. An eighth inner diameter portion 250 extends inwardly from the seventh inner diameter portion 248 to a ninth inner diameter portion 252.

Figure 3:
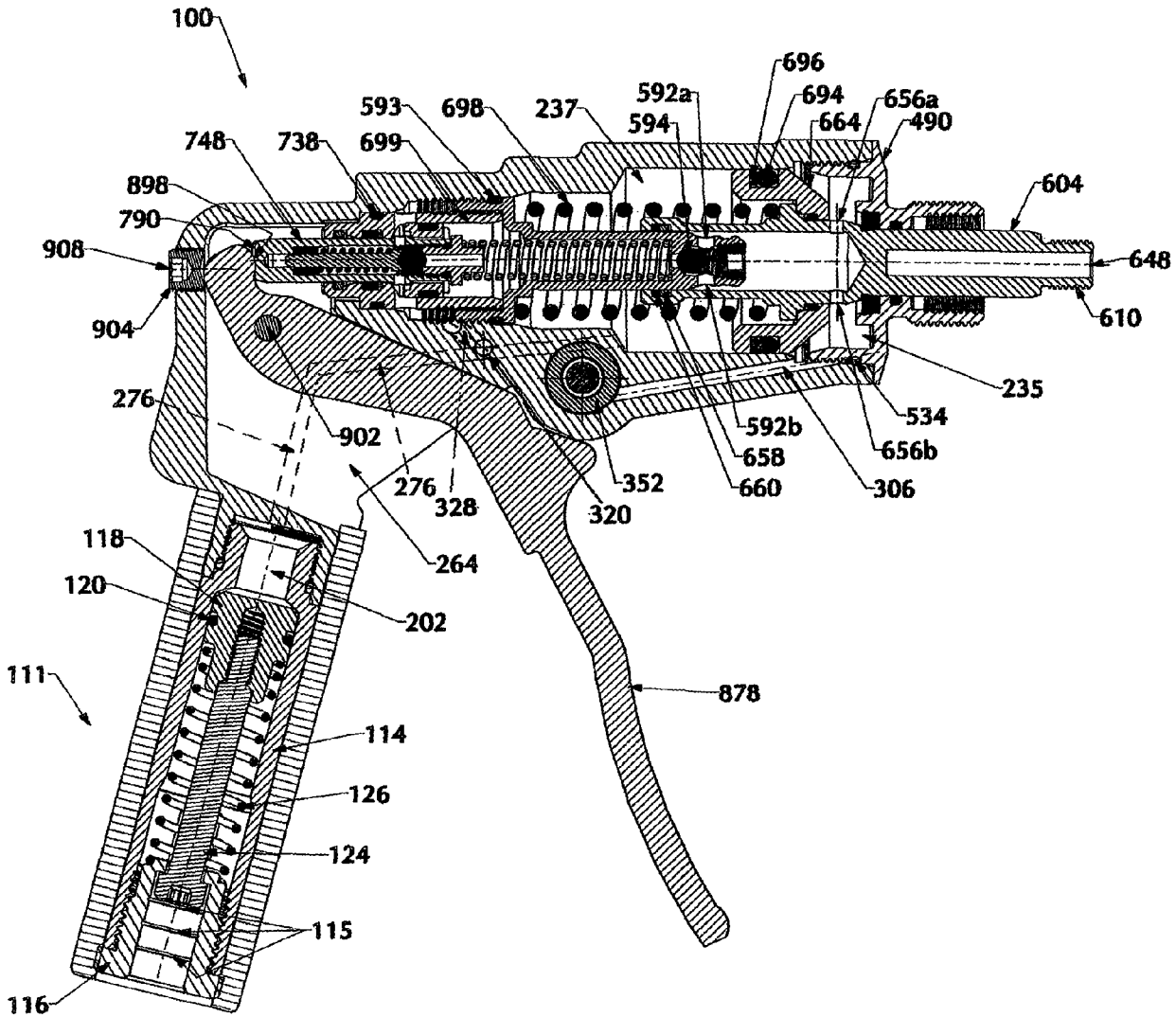
FIG. 3 is a cross sectional view of the tool illustrated in FIG. 2*a* taken along line 4-4, illustrating the pressurized fluid path shown before pumping.
Figure 10:
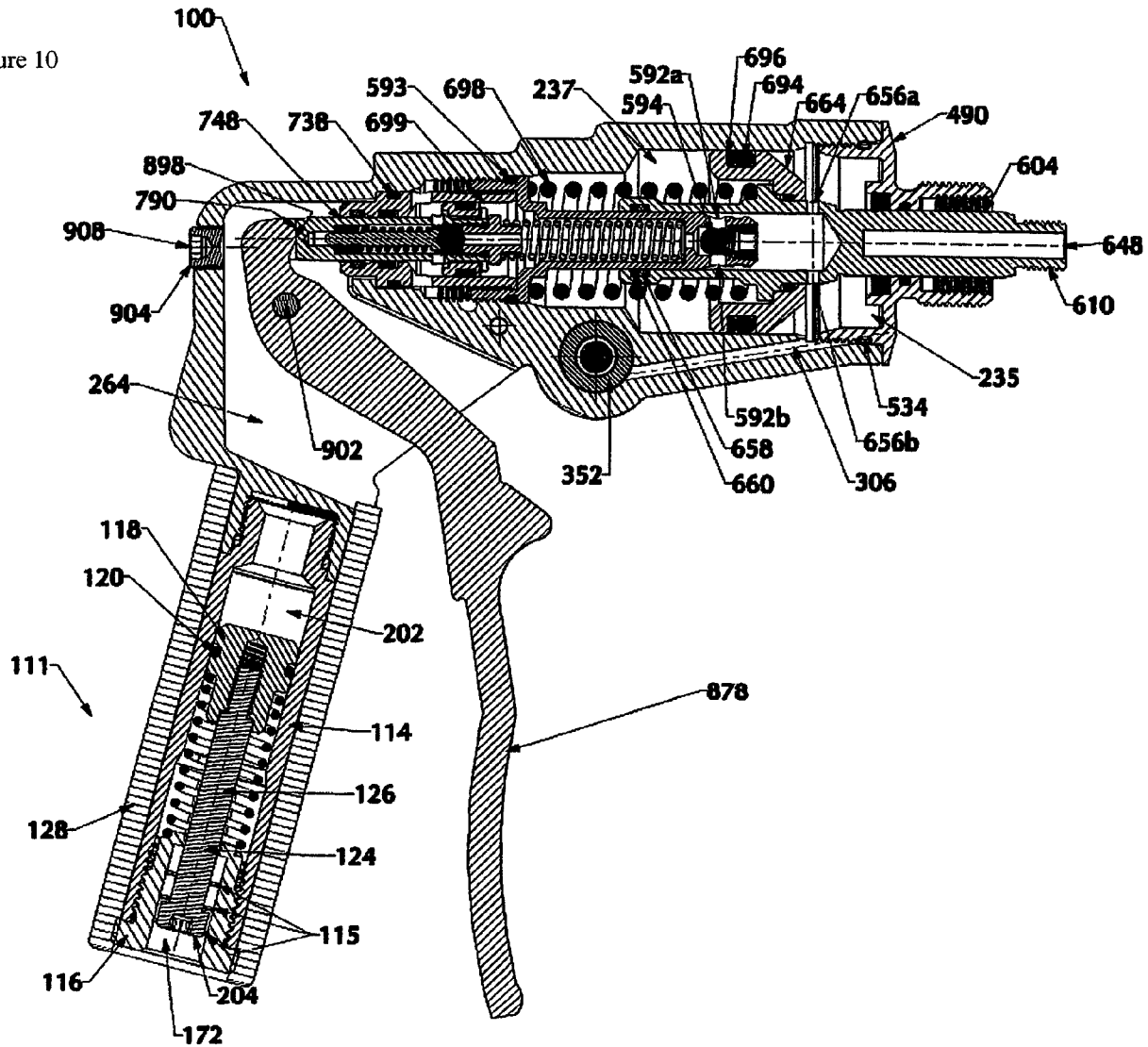
FIG. 10 is a cross sectional view of the tool illustrated in FIG. 2*a* taken along line 4-4, illustrating the pressurized fluid path shown while pumping.

As best shown in FIGS. 3, 5*a* and 10, the tool 100 includes a stationary handle 111 which includes a cylindrical extension 112 of the housing 102, a reservoir cylinder 114 covered by an insulation sleeve 128, a reservoir plug 116, a reservoir piston 118, an O-Ring 120, a movable shoulder screw 124 that connects the reservoir piston 118 with the reservoir plug 116, and a compression spring 126. The cylindrical extension 112 is best illustrated in FIG. 5*a*. The cylindrical extension 112 extends downwardly from a lower side of the housing 102 proximate to the closed end 108, and extends outwardly in an opposite direction from the open end 106, preferably at an angle of approximately seventy-five degrees relative to the centerline 104. The cylindrical extension 112 has an opening 132 which extends inwardly from a free end toward the housing 102. An inner wall 134 of the cylindrical extension 112 that is defined by the opening 132 is at least partially threaded. The inner wall 134 is preferably cylindrical in configuration and may be slightly tapered proximate to the free end. The cylindrical extension 112 preferably extends downwardly and outwardly from the housing 102.

As best illustrated in FIG. 3, the reservoir cylinder 114 is preferably threaded into the cylindrical extension 112 of the housing 102, and is preferably elongated in configuration. Alternatively, if desired, the reservoir cylinder 114 could be integrally cast on the housing 102.

The reservoir plug 116 is best illustrated in FIG. 10 and is preferably an aluminum component externally threaded and generally cylindrical in configuration. An internal aperture 172 is provided through the reservoir plug 116. The reservoir plug 116 is threaded into the reservoir cylinder 114 on the underside of the handle 111, such that the reservoir plug 116 is a stationary member upon being threaded into place.

As best illustrated in FIG. 10, the spring 126 is preferably a coiled compression spring that is positioned between the face of the reservoir plug 116 located inside the reservoir cylinder 114 and abuts against the reservoir piston 118, such that the spring 126 normally pushes the reservoir piston 118 upwards, away from reservoir plug 116. The reservoir piston 118 is preferably threaded onto the shoulder screw 124, and a head 204 of the shoulder screw 124 is preferably always positioned within the internal aperture 172 of the reservoir plug 116, such that the head 204 may be positioned anywhere within markings 115 of the internal aperture 172 of the reservoir plug 116.

A reservoir 202 of the handle 111 is defined by the reservoir piston 118, the reservoir cylinder 114, the cylindrical extension 112 and the housing 102. The O-ring 120 is provided around the reservoir piston 118 and keeps a water-tight seal between the reservoir piston 118 and the reservoir cylinder 114.

As best illustrated in FIG. 10, the sleeve 128 is made out of a cushioning, insulating material such as rubber or foam. It is preferably generally cylindrical in configuration, preferably has a diameter of about 1⅛ inches, and preferably has a wall thickness around 3/16 inches. The sleeve 128 is tightly fit over the reservoir cylinder 114 and abuts against the lower side of the housing 102 at one side, flush with the reservoir plug 116 on the other side.

As best illustrated in FIG. 5*a*, the housing 102 includes a slot 264 provided proximate to the rear closed end 108 which is accessible through the handle 111 side of the housing 102, but forward of the cylindrical extension 112. The slot 264 is in communication with the recess 110 through the eighth inner diameter portion 250 of the recess 110.

An aperture 266 is provided through the rear closed end 108 of the housing 102. The aperture 266 has a center which is slightly below the centerline 104. The aperture 266 defines a threaded aperture wall 268 of the housing 102. The aperture 266 is in communication with the slot 264.

As best illustrated in FIG. 5*a*, an aperture 270 is provided through both sides of housing 102 proximate to the rear closed end 108.

Figure 2A:
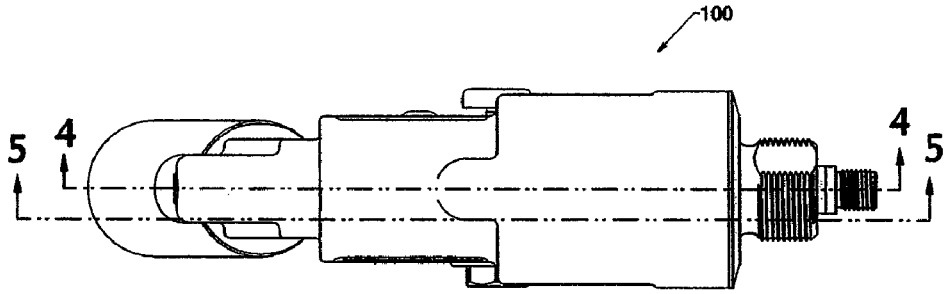
FIG. 2*a* is a top view of the tool illustrated in FIG. 1, showing the section planes 4-4 and 5-5.
Figure 4:
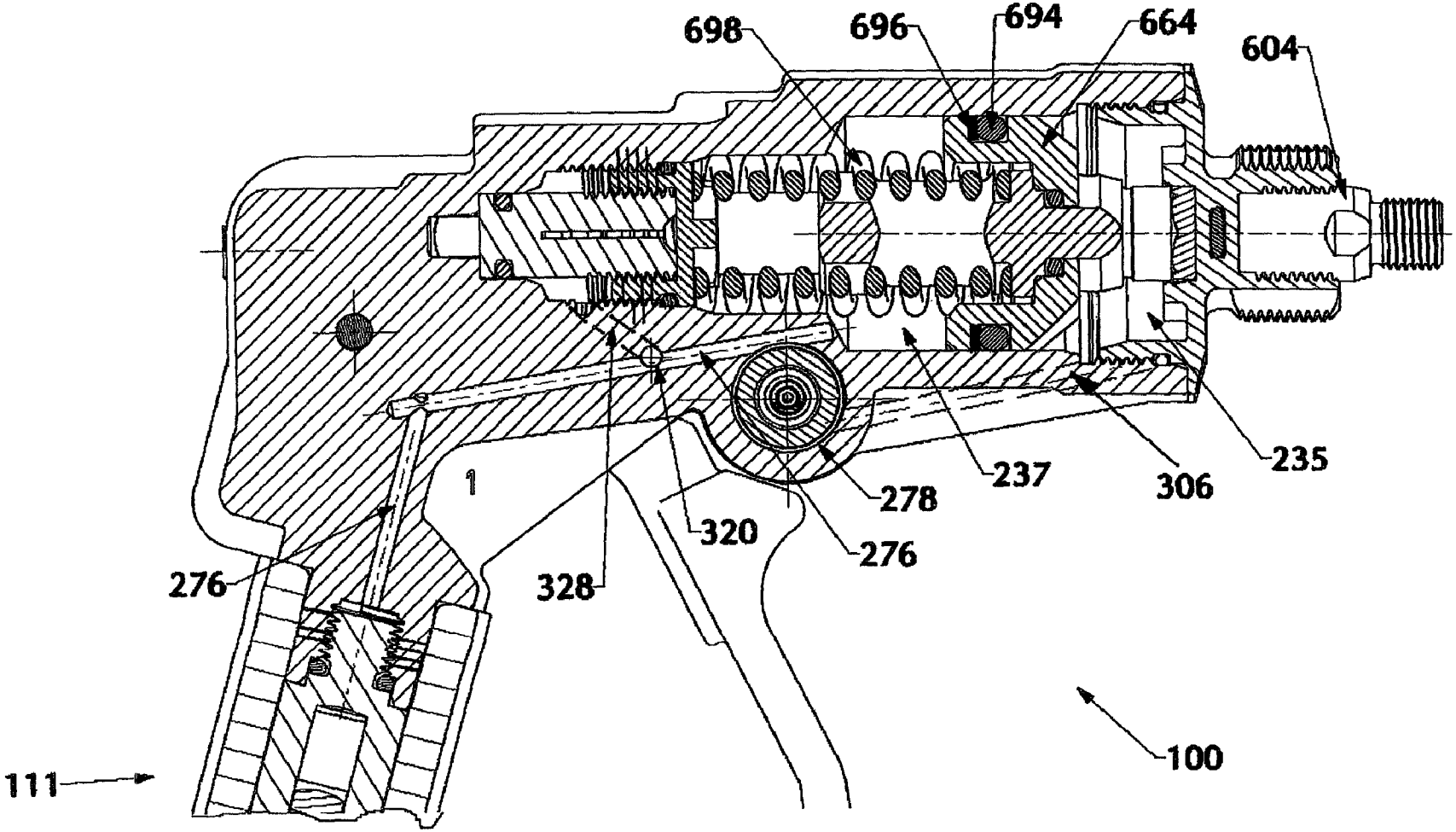
FIG. 4 is a cross sectional view of the tool illustrated in FIG. 2*a* taken along line 5-5 illustrating the fluid path to the reservoir.

As best shown in FIGS. 4 and 5*a*, an off-center passageway 276 is provided through the housing 102 along the line 5-5 illustrated in FIG. 2*a*, which connects the reservoir 202 of the handle 111 to a reservoir chamber 237 in the recess 110 of the housing 102. A first end of the off-center passageway 276 is in communication with the opening 132 of the cylindrical extension 112 and a second end of the off-center passageway 276 is in communication with the third inner diameter portion 234 defined by the recess 110 of the housing 102.

Figure 5B:
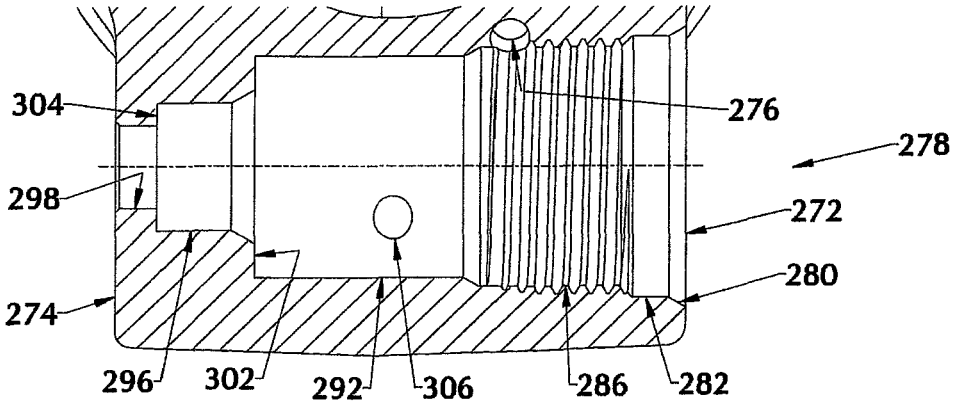
FIG. 5*b* is a partial cross sectional view of housing 102 along section plane 6-6.

As best illustrated in FIG. 5*b*, an aperture 278 is provided through the side of housing 102 approximately midway between the forward open end 106 and the rear closed end 108, and is preferably positioned below the smaller fourth inner diameter portion 238 defined by the recess 110 of the housing 102. The aperture 278 extends through the housing 102 from the right side 272 of the housing 102 to the left side 274 of the housing 102.

The aperture 278 defines a plurality of inner diameter portions 280, 282, 286, 292, 296, 298, of the housing 102. A first inner diameter portion 280 tapers from the right side 272 of the housing 102 to a second inner diameter portion 282 which, in turn, extends to a third inner diameter portion 286, which is preferably threaded, which, in turn extends to a forth inner diameter portion 292 which, in turn, extends to a first shoulder 302.

A smaller fifth inner diameter portion 296 extends beyond the first shoulder 302 to a second shoulder 304, with a tapered transition at the first shoulder 302. A sixth inner diameter portion 298 extends from second shoulder 304 through the left side 274 of housing 102. The off-center passageway 276 is in communication with the aperture 278 through the third inner diameter portion 286.

As best illustrated in FIGS. 3, 5*a* and 5*b* a passageway 306 extends between the recess 110 and the aperture 278 in a plane along the axis of recess 110, A first end of the passageway 306 is in communication with the threaded second inner diameter portion 228 of recess 110 of the housing 102 and a second end of the passageway 306 is in communication with the fourth inner diameter portion 292 defined by the aperture 278 of the housing 102.

Figure 2B:
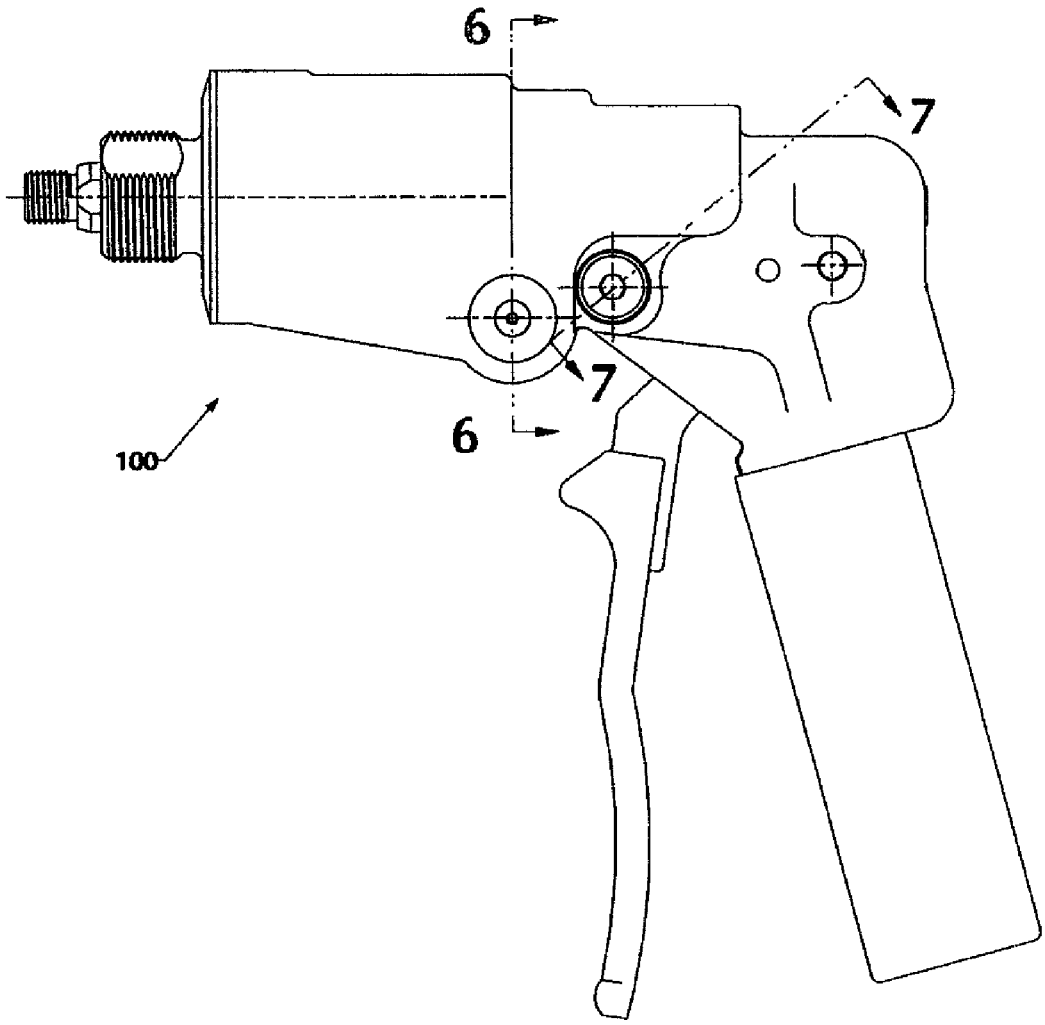
FIG. 2*b* is a side view of the tool illustrated in FIG. 1, showing the section planes 6-6 and 7-7.
Figure 6:
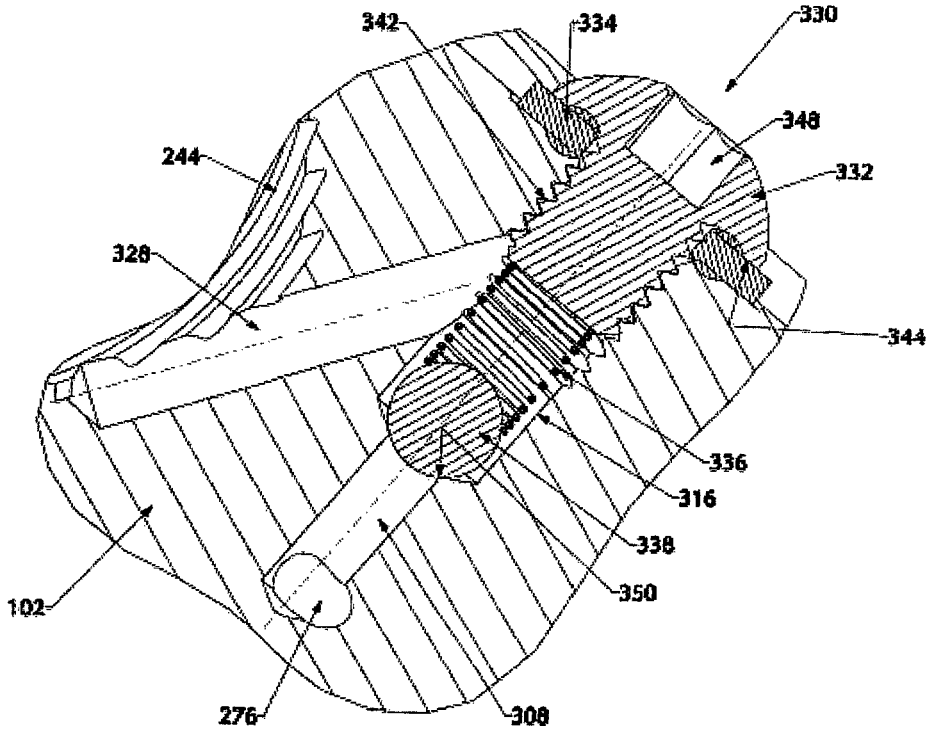
FIG. 6 is a partial cross sectional view of the tool illustrated in FIG. 2*b* taken along line 7-7 showing the check valve closed, while pumping.

As best illustrated in FIG. 6 a check valve recess is provided on the left side 274 of the housing 102 and along the plane 7-7 illustrated in FIG. 2*b*. The check valve recess is preferably positioned below the fifth and sixth inner diameter portions 242, 244 defined by the recess 110 of the housing 102 and away from the slot 264. The check valve recess defines a plurality of inner diameter portions 308, 316, 350 of the housing 102. The larger, threaded inner diameter portion 316 extends from the left side 274 of the housing 102 toward the right side 272 of the housing 102 to a sealing edge 350 transitioning through a tapered surface into a smaller inner diameter portion 308. The off-center passageway 276, which is in communication with the smaller inner diameter portion 308, connects the check valve recess with the fluid reservoir chambers 237 and 202.

As best illustrated in FIGS. 3 and 6, a passageway 328 extends between the recess 110 and the threaded inner diameter portion 316 of the check valve recess. A first end of the passageway 328 is in communication with the sixth inner diameter portion 244 defined by the recess 110 of the housing 102 and a second end of the passageway 328 is in communication with the threaded inner diameter portion 316 defined by the check valve recess of the housing 102.

As best illustrated in FIG. 6 a check valve assembly 330 is provided which includes a screw 332, a face seal 334, a spring 336 and a check valve (preferably in the form of a ball) 338, which is preferably formed of steel. The screw 332 is fully threaded into the threads 342 of inner diameter portion 316 with the face seal 334 squeezed between the left side 274 of the housing 102 and the underside 344 of the head of screw 332. The face seal 334 prevents leakage of pressurized fluid at the screw 332. The cheek valve 338 is pushed into the sealing edge 350 of the housing 102 by the spring 336, preferably a small, light coiled compression spring which abuts against an end of the screw 332 at a first end thereof, and against the check valve 338 at a second end thereof. Thus, under normal operating conditions, as the screw 332 is fixed in place by the threaded engagement, the spring 336 forces the check valve 338 against the sealing edge 350, thus preventing any fluid communication between the inner diameter portions 308, 316 of the check valve recess.

Figure 7A:
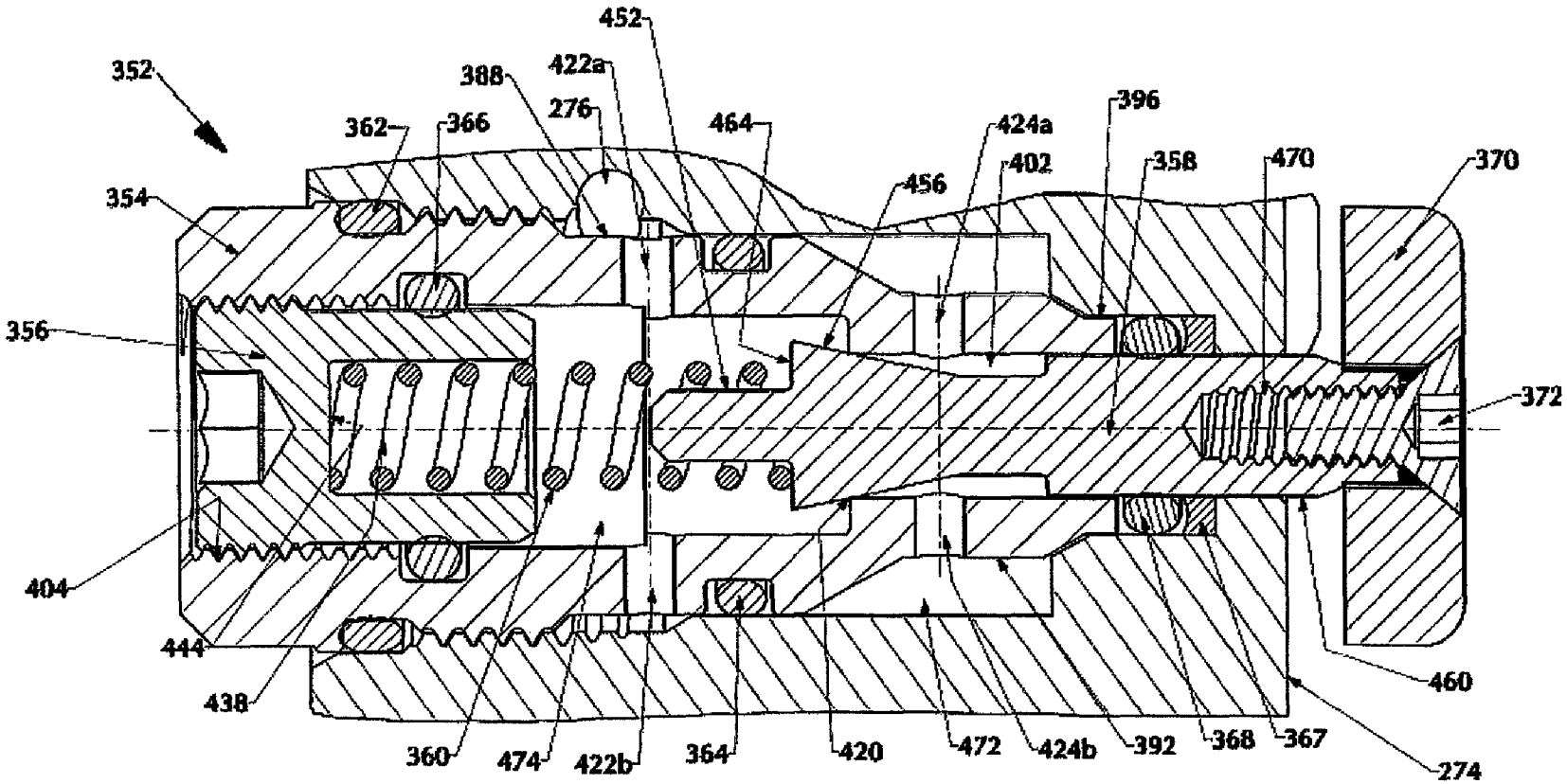
FIG. 7*a* is a cross sectional view of the tool illustrated in FIG. 2*b* taken along line 6-6 showing the pressure relief valve in closed position.
Figure 7B:
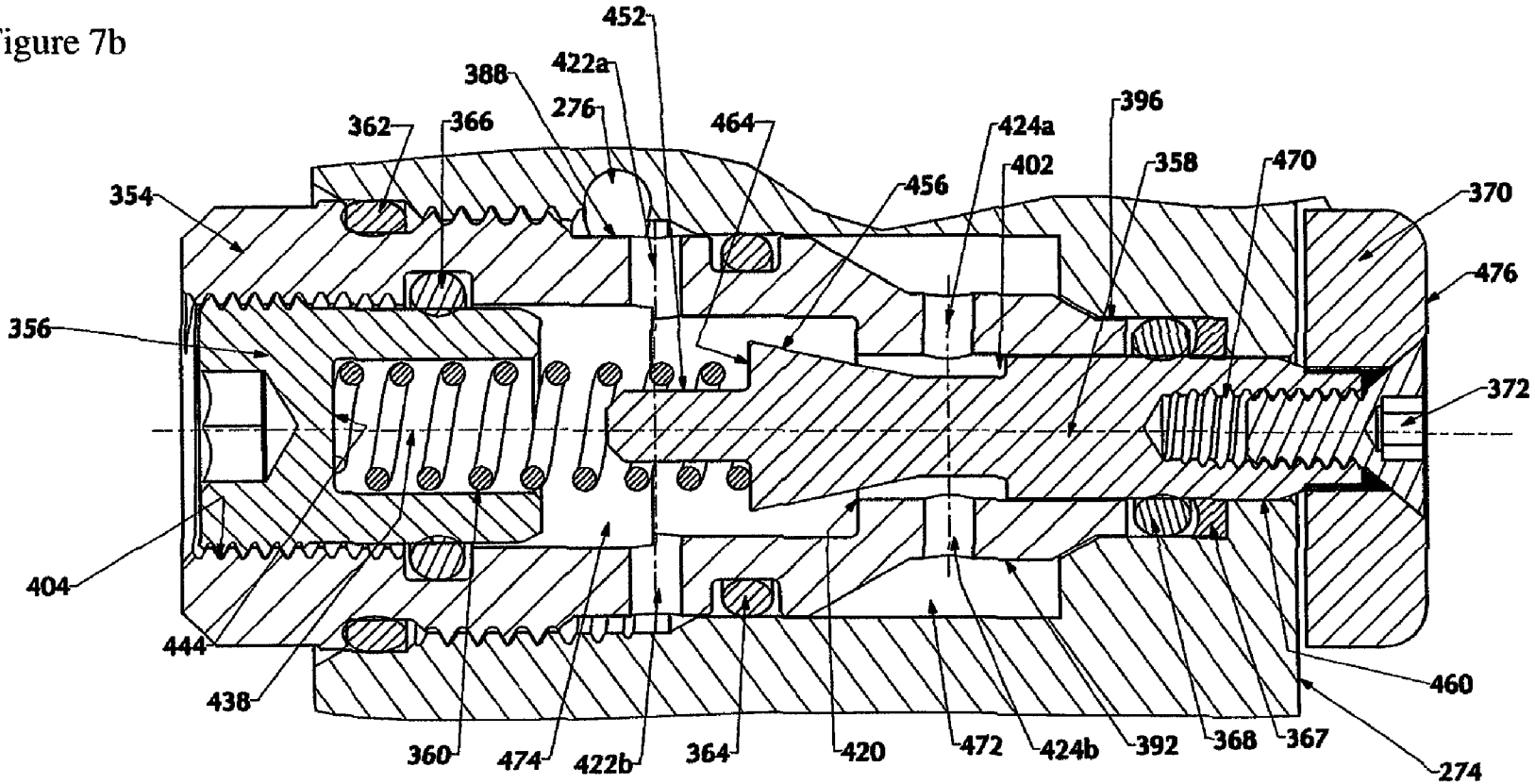
FIG. 7*b* to view from FIG. 11*a* showing the pressure relief valve open.

As best illustrated in FIGS. 7*a* and 7*b* a pressure relief valve assembly 352 is provided which includes a valve body 354, a pressure adjustment plug 356, a valve poppet 358, a spring 360, the first, second third and forth O-rings 362, 364, 366 and 368, and a back-up ring 367. The valve body 354 is generally cylindrical in configuration, is partially externally threaded, and has external and internal O-Ring grooves. The part of the valve body 354 protruding out of the housing 102 of the tool 100 has driving flats on it for easy tightening. An internal cavity of the valve body 354 has an internal thread 404 extending to the internal O-Ring groove, into the low pressure chamber 474 extending to a face containing a sealing edge 420 and breaks through the opposite side. The side holes 422*a*, 422*b* are provided through the valve body 354 located close to the external thread. The side holes 424*a*, 424*b* are provided through valve body 354 at diameter portion 392.

As best illustrated in FIGS. 7*a* and 7*b*, the valve body 354 is threaded into the aperture 278 of the housing 102. The side holes 422*a*, 422*b* are thus positioned in general or close alignment with the off-center passageway 276. The first O-ring 362 of the pressure relief valve assembly 352 is squeezed between the second inner diameter portion 282 of the housing 102 and the external groove in valve body 354. The second O-ring 364 of the pressure relief valve assembly 352 is squeezed between the fourth inner diameter portion 292 of the housing 102 and an O-Ring groove in the valve body 354, close to the tapered transition to the diameter portion 392. The second O-ring 364 is formed of a high-strength material capable of holding very high pressures without a back-up ring, such as polyurethane. This second O-ring 364 prevents leakage of pressurized fluid between the areas of the valve cavity communicating to the fluid pathways 306 and 276. The pressure adjustment plug 356 is generally cylindrical in configuration and is threaded into the valve body 354. The third O-ring 366 is squeezed between the outside surface of the pressure adjustment plug 356 and the internal O-Ring groove of valve body 354 prevents external leakage of fluid and provides the friction to hold the pressure adjustment plug 356 at the adjusted position.

As best illustrated in FIGS. 7*a* and 7*b*, the valve poppet 358 is generally cylindrical and it has a small diameter pilot 452 to guide a spring 360, a larger diameter at face 464, a tapered sealing face 456 extends to a smaller clearance diameter 402 and a seal diameter 460 at the end protruding out of the left side 274 of the housing 102. An axial internal thread 470 is provided at the end protruding out of the left side 274 of the housing 102. The fourth O-ring 368 and the back-up ring 367 are placed inside the fifth inner diameter portion 296 between valve body 354 and the second shoulder 304 of the housing 102 and it is squeezed between seal diameter 460 of valve poppet 358 and the fifth inner diameter portion 296 of the housing 102. The left side, at face 464, and part of the tapered sealing face 456 of valve poppet 358 are positioned on the left side of sealing edge 420 of valve body 354. The spring 360 guided inside the internal recess 438 of plug 356 and pilot 452 of valve poppet 358 is compressed between the face 444 of the pressure adjustment plug 356 and face 464 of valve poppet 358 pushes the tapered sealing face 456 of the valve puppet 358 into the sealing edge 420 of the valve body 354. With the valve poppet 358 wedged into the sealing edge 420 of the valve body 354, a high pressure chamber 472 is defined behind the seal, i.e., between the seal and the fourth O-Ring 368. Also, a low pressure chamber 474 is defined in front of the seal, i.e., between the seal and the pressure adjustment plug 356.

Figure 15A:
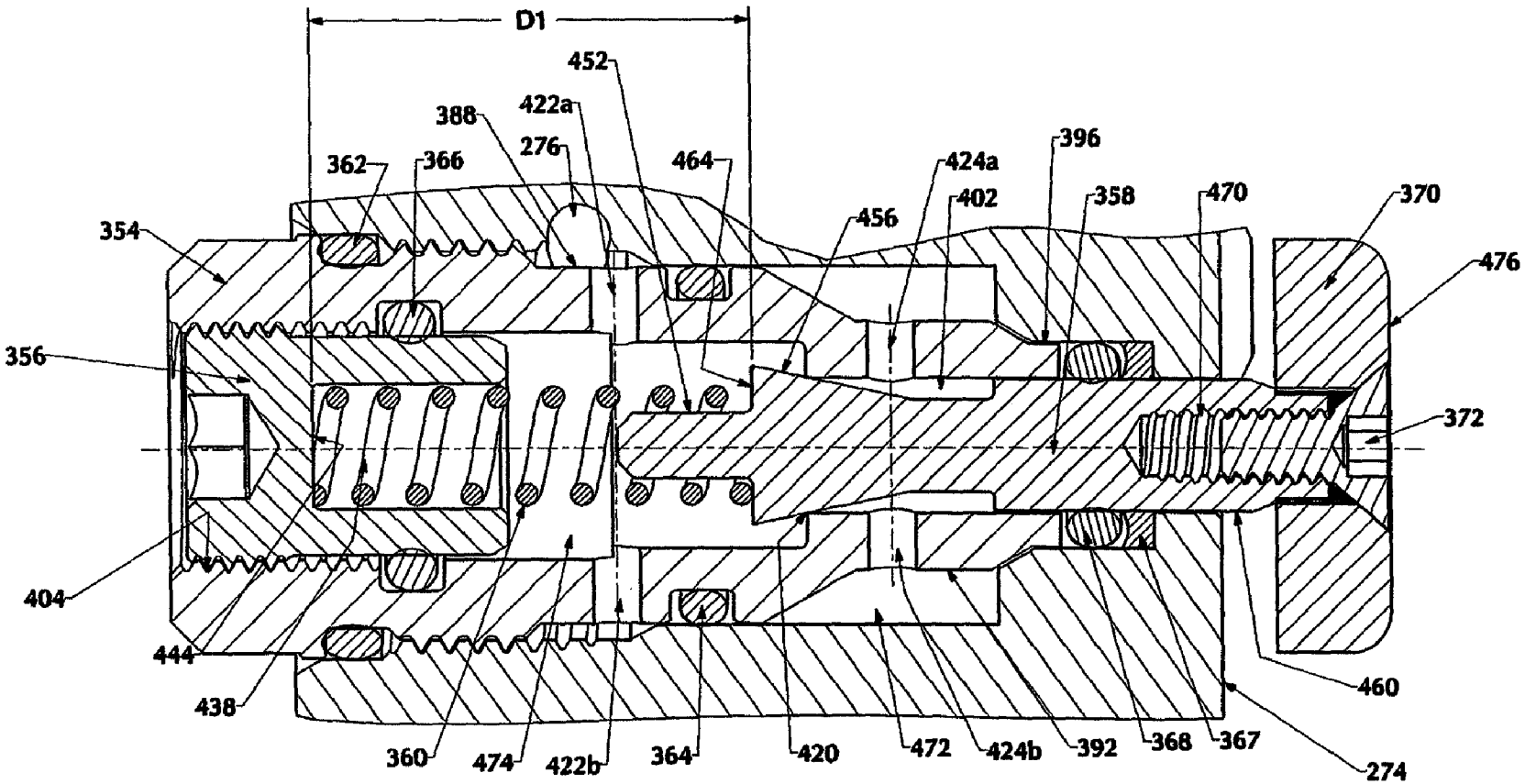
FIG. 15*a* is a cross sectional view of the tool illustrated in FIG. 2*b* taken along line 6-6 showing the pressure relief valve adjusted for a low pressure.
Figure 15B:
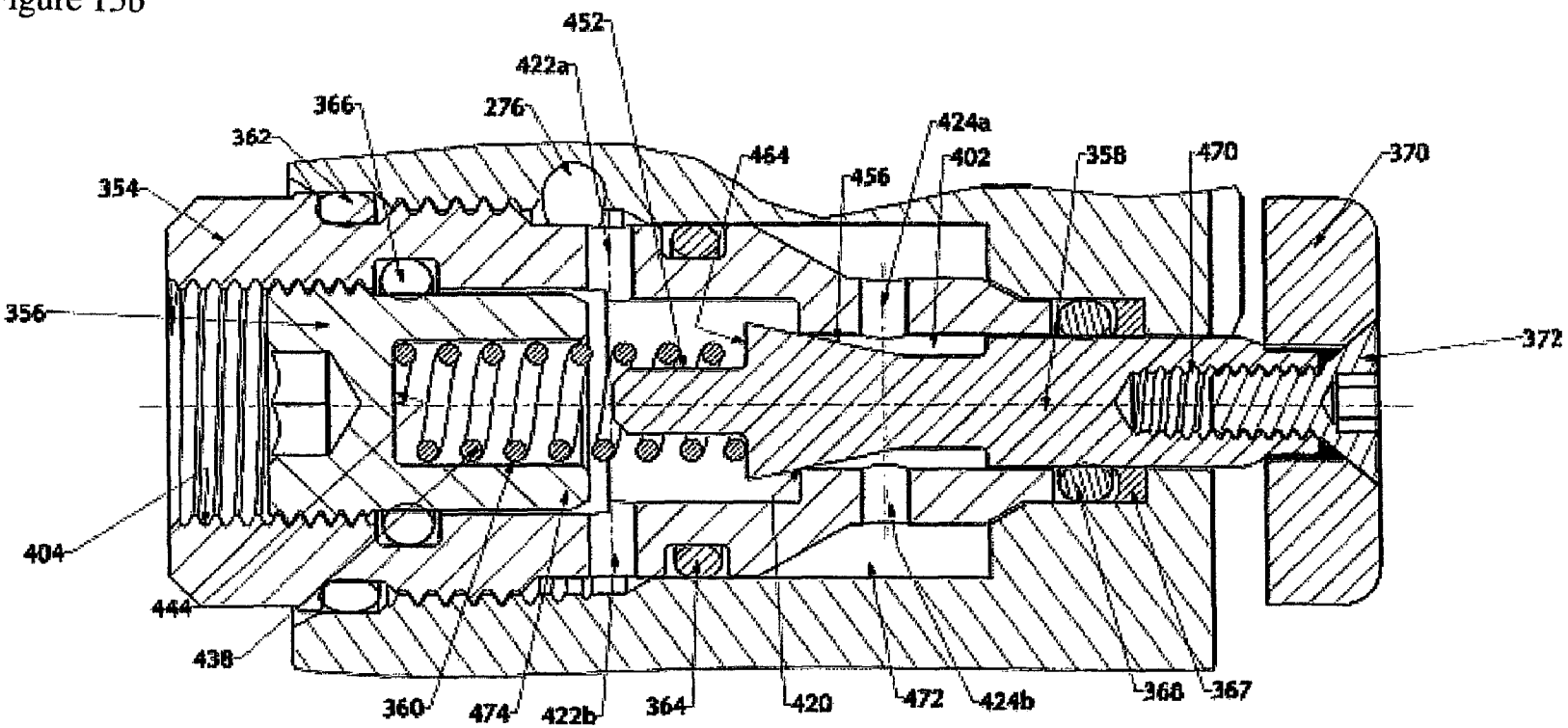
FIG. 15*b* illustrates the pressure relief valve from FIG. 11*a* adjusted for high pressure.

As best seen in FIGS. 15*a* and 15*b*, the force in the spring 360 can be increased by threading the pressure adjustment plug 356 into the valve body 354, therefore compressing the spring 360, or decreased by threading it outwards, away from the valve poppet 358, therefore relaxing the spring 360.

As best illustrated in FIGS. 7*a* and 7*b*, a button 370, which is preferably formed of metal or plastic and which is preferably generally cylindrical in configuration, is assembled to the end of the valve poppet 358 that protrudes out of the left side 274 of the housing 102. The button 370 is held in place by a flush head screw 372 threaded into the threaded opening of valve poppet 358.

Figure 3A:
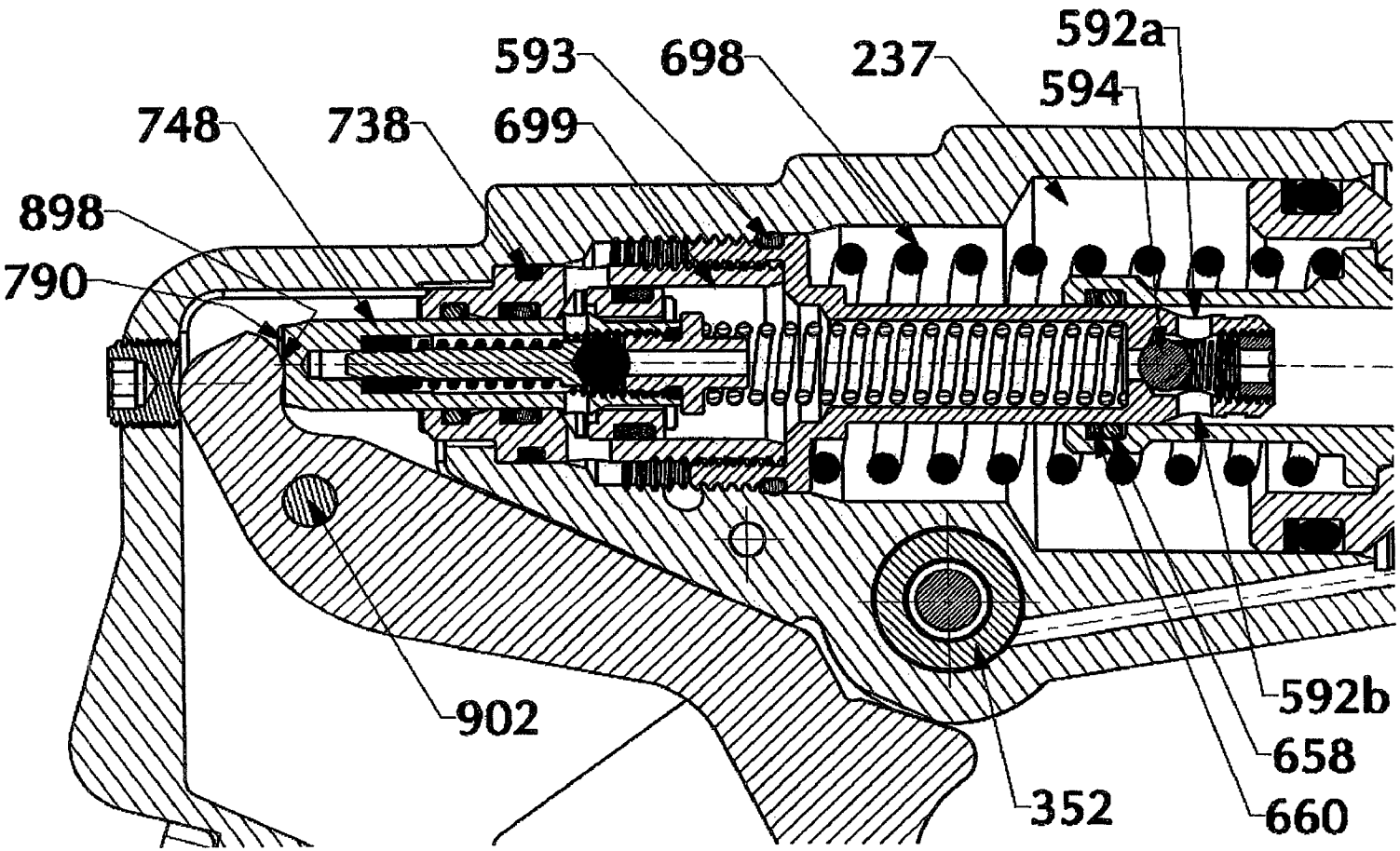
FIG. 3*a* is an enlarged view of FIG. 3 showing the main operational components.
Figure 8:
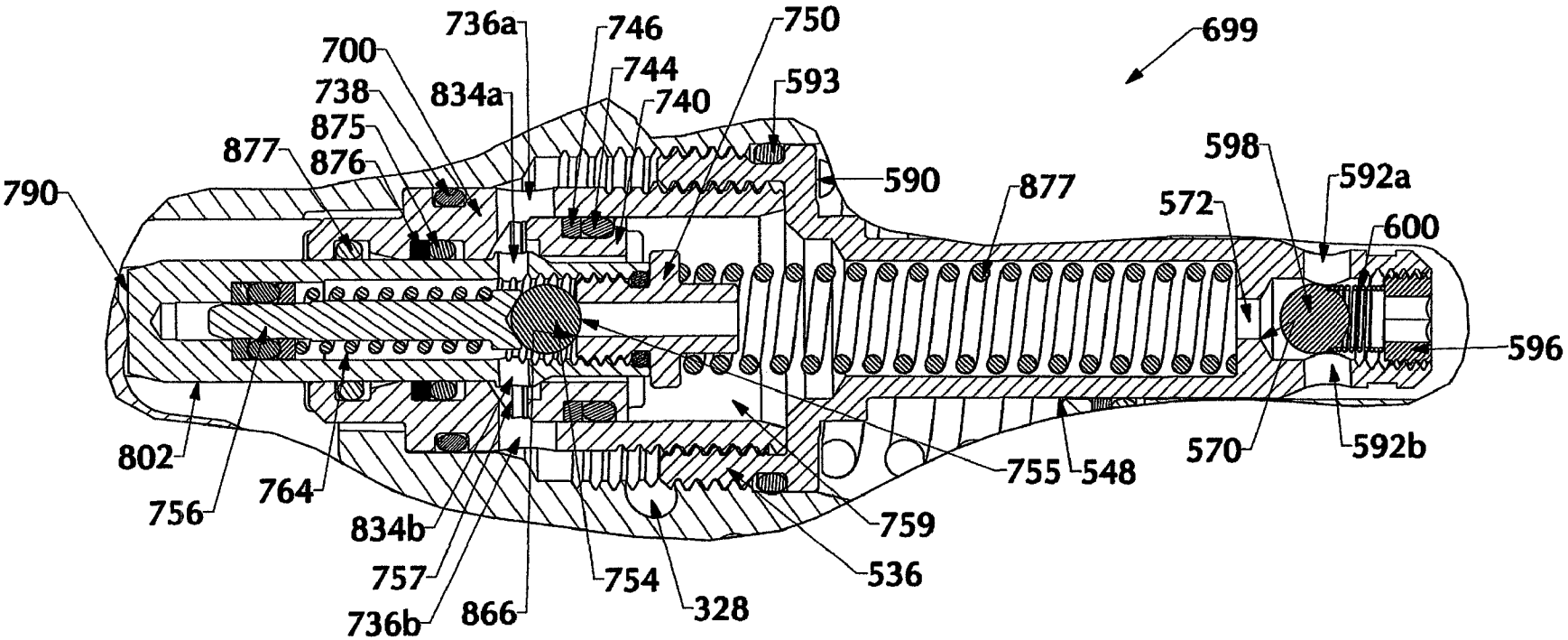
FIG. 8 is a cross sectional view of the tool illustrated in FIG. 2*a* taken along line 4-4, illustrating the hydraulic pump assembly 699 when pumping.

As best shown in FIGS. 3*a* and 8, a hydraulic pump assembly 699 is provided which includes a pump housing 700 threaded into a pump spring housing 536. The pump spring housing 536 is threaded inside the recess 110 of the housing 102 into the sixth inner diameter portion 244.

As best illustrated in FIG. 8, the pressure is held from leaking on either side of the hydraulic pump assembly 699 by the high strength O-Rings 593, 738 on the right and left sides, respectively. The right side of the pump spring housing 536 has a wrenching hex 550 used during pump assembly, and a slimmer diameter portion 548 which slides into an opening 650 of a piston rod 604. An internal O-Ring 658 and a back-up ring 660 prevent pressurized fluid from leaking out of the opening 650 of piston rod 604 and into the reservoir chamber 237 of the tool 100.

Inside the pump housing 700, a pump piston assembly 740 is slideably mounted. A compression spring 877 placed inside of the pump spring housing 536 pushes onto the front face 854 of the pump piston assembly 740 causing it to be pushed backwards, away from the pump spring housing 536. At the right side, the pump spring housing 536 has a small opening 572, a sealing edge 570 and a larger threaded opening at the rightmost side. Two side holes 592*a* and 592*b* provide free passage of the pressurized fluid into the opening 650 of piston rod 604. A check valve 594, preferably in the form of a ball, is pushed into the sealing edge 570 of pump spring housing 536 by a coiled spring 600, biased on the right side by a hollow set screw 596 threaded into the right opening of the pump spring housing 536.

The pump piston assembly 740 protrudes through the rear of pump housing 700. A set of dynamic seals composed of an O-ring 875 and a back-up ring 876 prevent leakage along the diameter portion 802 of pump piston rod 748 protruding out of the pump housing 700.

As best illustrated in FIG. 8, two side openings 736*a* and 736*b* drilled through the pump housing 700 allow free passage of fluid from the pump chamber 757 to the sixth inner diameter portion 244 of the recess 110 of the housing 102.

Figure 9:
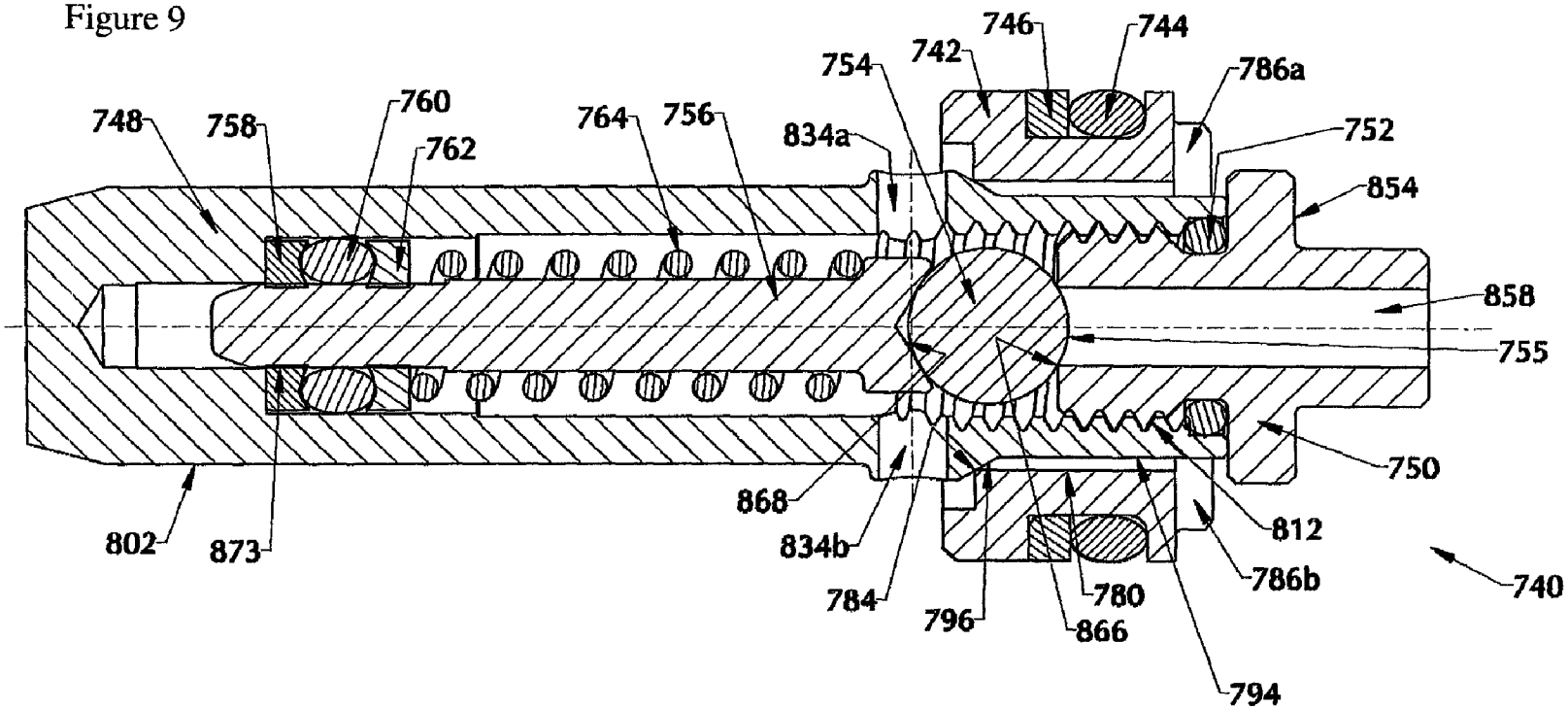
FIG. 9: cross sectional view of pump piston 742

As best illustrated in FIG. 9 the pump piston assembly 740 is comprised of a pump piston rod 748 and a pump piston 742 held together by piston cap 750. The pump piston rod 748 is preferably a metallic cylinder having an axial threaded opening at the right side, a clearance diameter 794, a tapered face 796 preferably about one-third of the way from the right side, and a smaller diameter portion 802 towards the left side. A smooth tapered transition at the left end ensures easy installation into the mating component. Inside the pump piston rod 748 opening, a plunger 756 is pushed forward towards a pressure-sensitive valve 754, preferably in the form of a ball, preferably formed of steel, by a compression spring 764. On the left side, a set of back-up rings 758, 762 and O-ring 760 are squeezed between the diameter portion 873 of plunger 756 and the opening in the pump piston rod 748 in order to prevent leakage of the pressurized fluid towards the left side of them. Although leakage would remain internal, the lack of pressure behind diameter portion 873 of plunger 756 will create an uncompensated pressure area during tool operation, such as that when pressure is present ahead of the plunger 756. The force of the uncompensated pressure applied on the conical face 868 of plunger 756 will keep the plunger 756 open as long as this force is able to overcome the spring 764 pushing the plunger 756 in the opposite direction. The pressure-sensitive valve 754 is pushed forward by the plunger 756 and spring 764 into the sealing edge 866 of piston cap 750. An O-Ring 752 prevents fluid leakage at the threads 812.

As best shown in FIG. 9, the pump piston 742 is preferably a cylindrical component with an O-Ring groove on the outside and a through-opening diameter 780. The left side of the pump piston 742 has a sealing edge 784, the right side having two face grooves 786*a* and 786*b*.

Figure 3B:
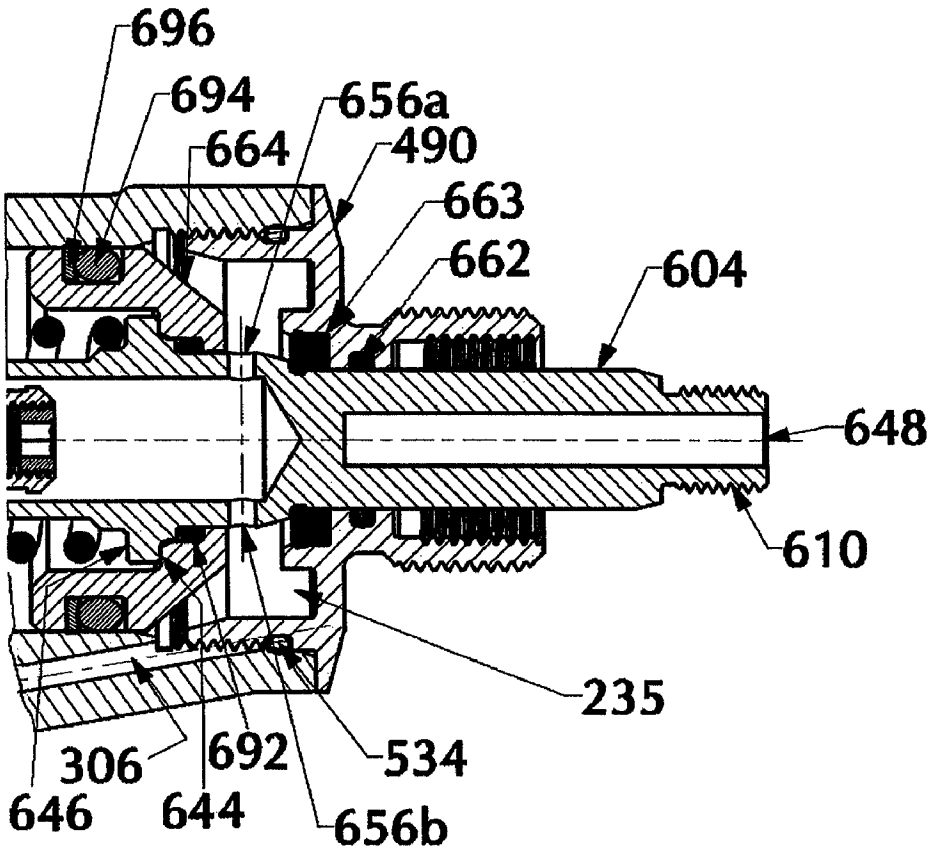
FIG. 3*b* is an enlarged view of FIG. 3 showing the threaded end of the tool 100.

As best illustrated in FIGS. 3, 3*a* and 3*b*, the piston rod 604 is preferably a cylindrical component that is preferably made of high strength steel. The piston rod 604 has an opening 650 on the left side, and a threaded portion 610 at the right side. As best illustrated in FIG. 3*b*, a piston 664, which is preferably cylindrical in configuration and preferably made out of brass or aluminum, is mounted on the piston rod 604 against a shoulder 644. An O-Ring 692 assembled between the piston 664 and the piston rod 604 prevents leakage of the pressurized fluid from pressure chamber 235 ahead of the piston 664 to the reservoir chamber 237 behind the piston 664. The O-ring 694 and back-up ring 696 serve the same purpose of insulating the right side of piston 664 (chamber 235) from the left side (chamber 237).

The fact that the reservoir chamber 237 is right behind piston 664 and part of the same hydraulic cylinder drastically reduces the amount of fluid necessary to operate the tool 100 since the fluid is recirculated between the chambers 235 and 237 on both sides of piston 664. Also, this design approach keeping likely potential wear fluid leaks internal increases the life of the tool, saves time and money to the user, and results in a more environmentally friendly tool. As best shown in FIG. 4, the reservoir chamber 237 is also connected to the reservoir 202 in the handle 111 via paths 276 in the housing 102. The reservoir piston 118 is pushed toward the fluid by spring 126, creating an internal pressure in the system above the atmospheric pressure. This pressure is necessary to open the check valve 338 shown in FIG. 6 and push fluid into the hydraulic pump assembly 699 shown in FIG. 8 when a lever 878 is released. As best shown in FIG. 3. The shoulder screw 124 is threaded into the reservoir piston 118 and moves with it as the reservoir piston 118 moves during tool operation. A series of grooves 115 inside the internal aperture 172 of the reservoir plug 116 give a visual indication of the position of the head 204 of shoulder screw 124 as it moves with the reservoir piston 118. The more fluid there is in the reservoir 202 of handle 111, the more the head 204 of the shoulder screw 124 connected to the reservoir piston 118 is pushed out of the handle 111. As shown in FIG. 10, when looking inside internal aperture 172 of the reservoir plug 116 only one indicator groove or marking 115 is visible if the tool 100 is full of fluid and in perfect working condition. As shown in FIG. 3, when there is no fluid, or the tool 100 is low on fluid, three indicator grooves or markings 115 are visible. These fluid level indicating grooves or markings 115 make troubleshooting and tool service much easier.

As illustrated in FIG. 3, cross holes 656*a* and 656*b* in the piston rod 604 secure free passage of the pressurized fluid from the opening 650 of piston rod 604 to the pressure chamber 235.

Figure 14A:
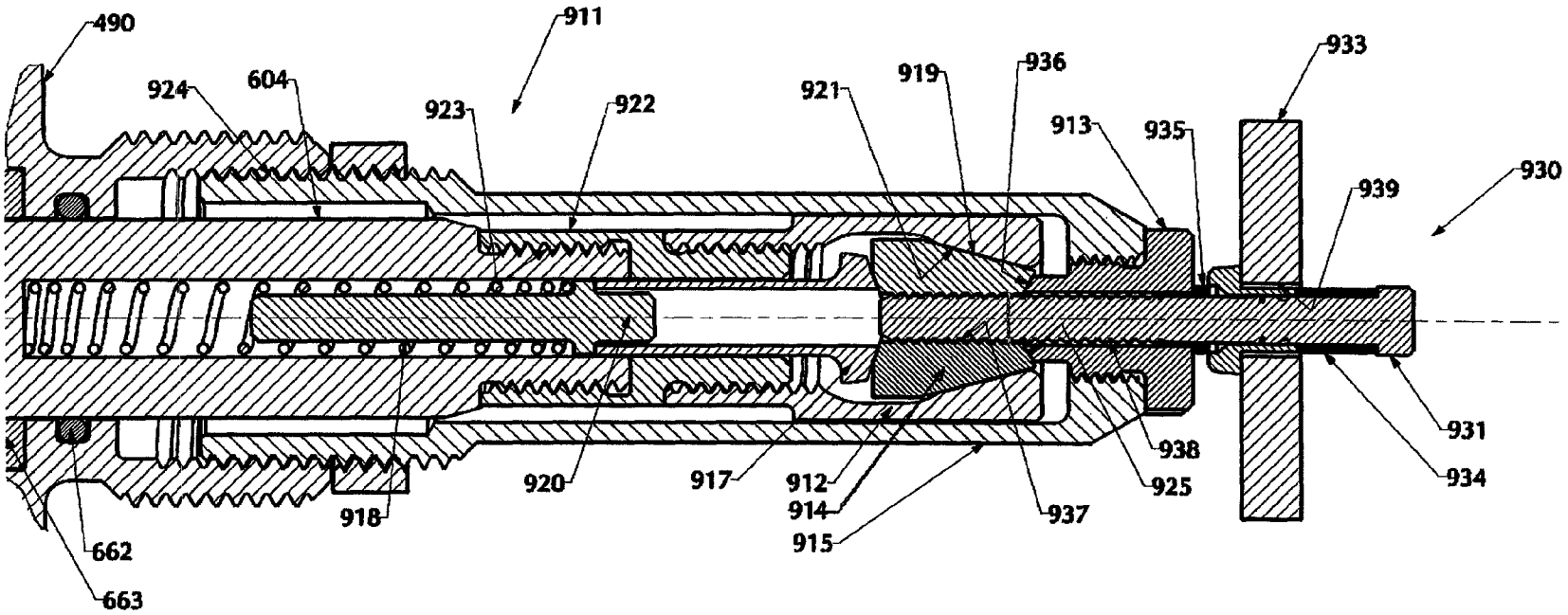
FIG. 14*a* is a cross sectional view of the tool illustrated in FIG. 2*a* taken along line 4-4 with a pulling head mounted and engaged with a blind fastener to be installed in a work-piece.
Figure 14B:
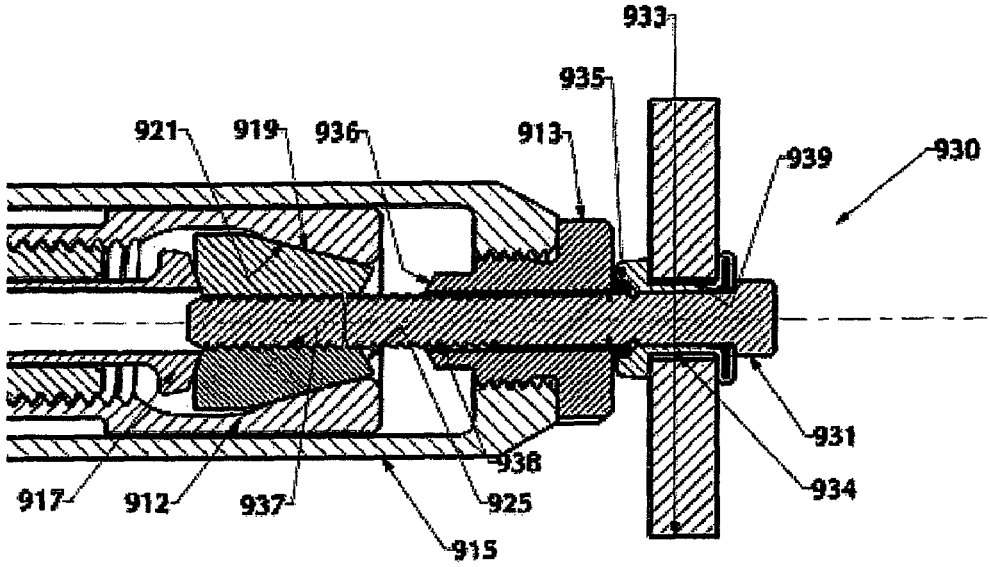
FIG. 14*b* illustrates the tool in FIG. 10*a* after setting the fastener.
Figure 14C:
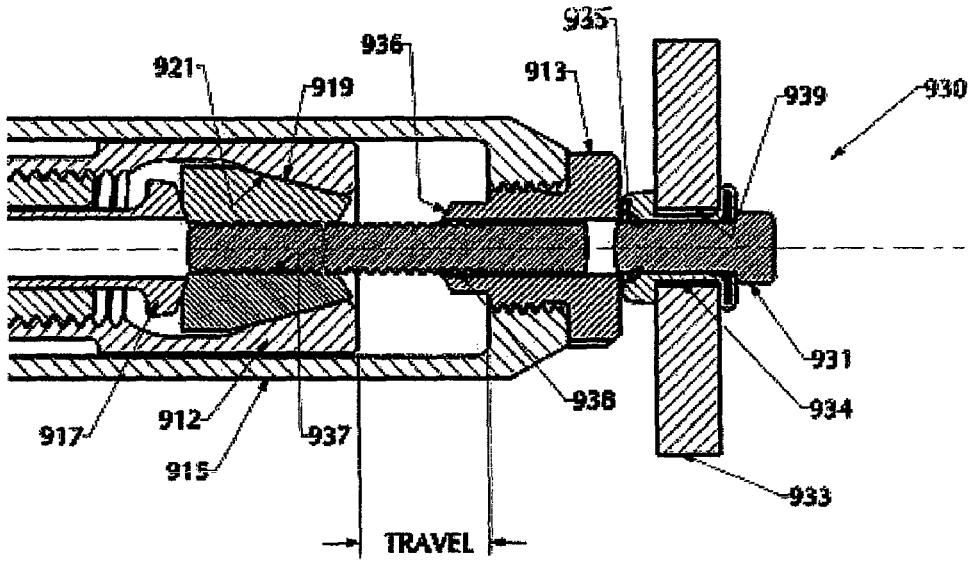
FIG. 14*c* illustrates the tool in FIG. 10*b* after completing fastener installation and breaking the stem.

As best illustrated in FIG. 14*a*, an end of the piston rod 604 protruding outside of the tool 100 is threaded, providing a way to assemble a drawbar 912 of a pulling head 911 which may be used to install blind fasteners. An axial blind opening 648 on the protruding side of the piston rod 604 provides room for a compression spring that may be used with a pulling head 911.

Alternatively, the piston 664 and piston rod 604 may be made in one piece eliminating the O-ring 692 and an assembly operation.

As best shown in FIG. 3*b*, an adaptor 490 is threaded into the second inner diameter portion 228 of housing 102. A pressure chamber 235 is defined between the piston 664 and the adaptor 490. The O-ring 534 squeezed between an external groove of the adaptor 490 and the first inner diameter portion 226 of housing 102 provides a static seal preventing fluid leakage through the second inner diameter portion 228 of the housing 102. An energized lip seal 663 and an internal O-ring 662 between piston rod 604 and adaptor 490 provide dynamic seals preventing pressurized fluid from leaking to the exterior of the tool 100 along the piston rod 604. The adaptor 490 may have internal or external threads on the side protruding out of the tool 100.

As best illustrated in FIG. 14*a*, a pulling head 911 may be mounted onto the threaded portion of the adaptor 490 and piston rod 604. The size and type of the threads on both the piston rod 604 and adaptor 490 depend on the type of pulling heads 911 the tool 100 is built to work with. Many variations of this tool 100 may be built, in order to accommodate many different pulling head mounting systems.

As best illustrated in FIG. 3, a large compression spring 698 biased on face 558 of hydraulic pump assembly 699 on one side and shoulder 646 of piston rod 604 on the other side provides the force to push the piston rod 604 with the piston 664 towards adaptor 490 when the pressure in pressure chamber 235 is relieved.

As best illustrated in FIG. 3, a hand lever 878, which is comfortable to grip with the fingers of one hand, is connected to the rear 790 of the pump piston 748 which protrudes out of the pump housing 700 and into the slot 264 in the housing 102. The lever 878 is assembled inside the slot 264 of the housing 102 and is pivotably connected to the housing 102 near the handle 111. In this fashion, the lever 878 pivots about a dowel pin 902 when squeezed by the operator's hand, pushing with top arm 898 onto face 790 of pump piston rod 748, causing it to reciprocate as the lever 878 is squeezed and released.

Figure 17A:
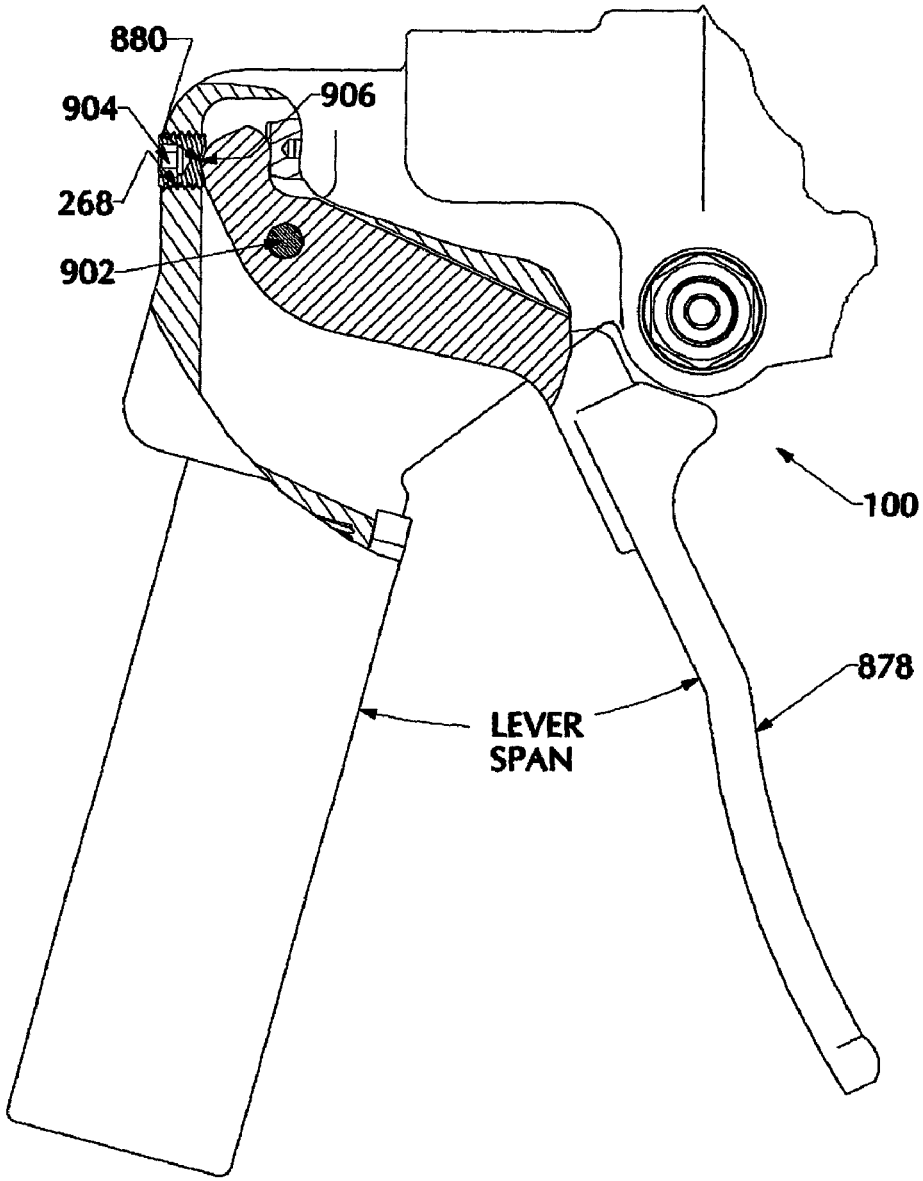
FIG. 17*a* is a partial section of tool illustrated in FIG. 2*a* taken along line 4-4 showing the lever adjusted farthest from the handle.
Figure 17B:
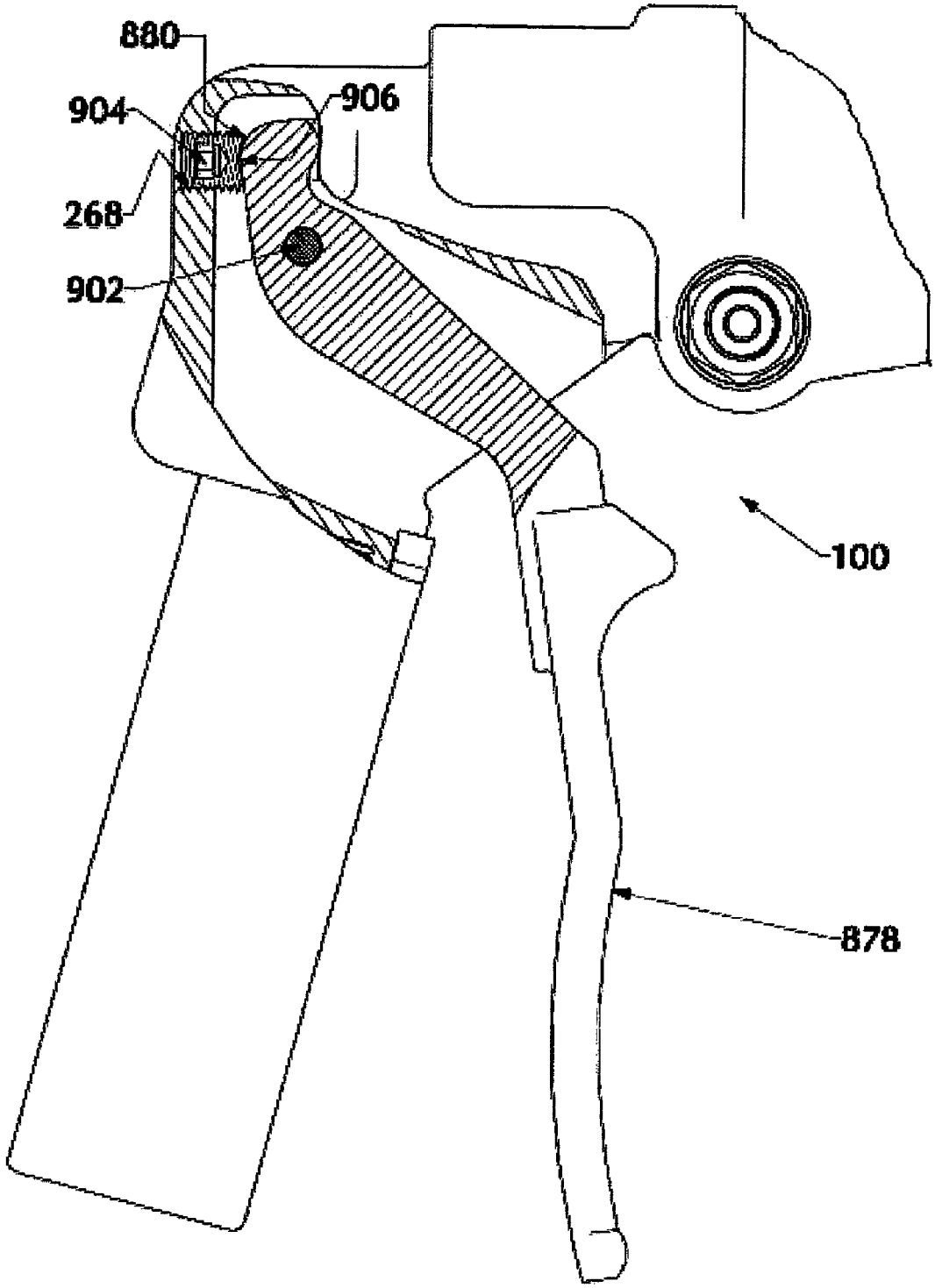
FIG. 17*b* is the tool illustrated in FIG. 13*a* showing the lever adjusted closer to the handle.

As best illustrated in FIGS. 17*a* and 17*b*, a set screw 904 is provided which is threaded into the threaded wall 268 of the aperture 266 formed in the housing 102. The face 906 of the set screw 904 facing the slot 264 of the housing 102 protrudes into the slot 264 and will stop the lever 878 from further pivoting when the face 880 of lever 878 hits the set screw 904. As best illustrated in FIG. 17*b*, by threading the set screw 904 into the housing 102 by the means of the hex recess 908, the set screw 904 will push onto the face 880 of lever 878, pushing it toward the hydraulic pump assembly 699. Since the lever 878 pivots around the dowel pin 902, this frontward movement of the face 880 of lever 878 will cause the end 872 protruding out of the housing 102 of the tool 100 to pivot closer to the handle 111, decreasing the "Lever Span" for a more comfortable grip.

Tool Operation

In operation, the operator grips the tool 100 in one hand and inserts a stem 931 of a fastener 930 into the opening of nose piece 913 as illustrated in FIG. 14*a*; a serrated portion 938 of the stem 931 will be engaged by internal serrations 937 of the jaws 914. The spring 918 permits the jaws 914 to open allowing the stem 931 to be inserted. The other side of the fastener 930 is then inserted into a hole 939 drilled into a work piece 933 (for example an aircraft structure to be repaired), or it can be inserted in the hole 939 of work piece 933 before placing in into the tool 100. The lever 878 is then pulled with the four fingers of one hand towards the handle 111, while holding onto the handle 111 with the thumb (throughout this document, this action will be named squeezing the lever 878). As seen in FIG. 12, the top arm 898 of the lever 878 pushes the pump piston 748 forward into the hydraulic pump assembly 699 pressing the tapered face 796 of pump piston rod 748 into the sealing edge 784 of pump piston 742. The friction caused by the O-Ring 744 and back-up ring 746 causes the pump piston 742 to resist movement. As a result, tapered face 796 of pump piston rod 748 wedges into the sealing edge 784 of pump piston 742 preventing the fluid in pressure chamber 759 of hydraulic pump assembly 699 from leaking behind the pump piston 742 by the way of face grooves 786*a*, 786*b* of pump piston 742 and the clearance between diameters 780 and 794 of pump piston rod 748 and pump piston 742.

In accordance with the preferred embodiment, a system is provided for attaining high pressure in pressure chamber 235 with low hand effort. More specifically, there is provided means for automatically converting the tool 100 back and forth between a low pressure mode and a high pressure mode, as needed during fastener installation. As best illustrated in FIG. 9, this system is encapsulated inside the pump piston assembly 740 of hydraulic pump assembly 699. The pressure-sensitive valve 754 is pushed by the conical face 868 of plunger 756 toward the sealing edge 866 of piston cap 750. The pushing force is provided by a coiled spring 764. As best illustrated in FIGS. 3, 8, 11*a* and 11*b*, when squeezing the lever 878, pressure is generated in pressure chamber 759 of hydraulic pump assembly 699 on the right side of pump piston 742. According to Pascal's law, the pressure is equally applied everywhere inside the hydraulic pump assembly 699 to the right side of the pump piston 742, therefore it also pushes the face 755 of the pressure-sensitive valve 754 within the aperture 858 in the piston cap 750. The fluid pressure will push the pressure-sensitive valve 754 in a direction away from the piston cap 750 with a force equal to the ball surface exposed to the pressure times the pressure. In a low pressure mode, the force pushing the pressure-sensitive valve 754 from the pressure side of the pump piston 742 does not overcome the compression spring 764 which pushes the pressure-sensitive valve 754 in opposite direction, the pressure-sensitive valve 754 remaining wedged into the scaling edge 866 of piston cap 750. This prevents the fluid in the pressurized side from leaking beyond the pressure-sensitive valve 754, so each stroke of lever 878 causes all the fluid at the right side of the pump piston 742 to pass through opening 572 of the pump spring housing 536 and by the check valve 594. In this manner, fluid is pumped out of the hydraulic pump assembly 699 into the pressure chamber 235 through the fluid path side holes 592*a* and 592*b* of the pump spring housing 536 and via cross holes 656*a* and 656*b* in the piston rod 604. The check valve 594 allows flow from the pump piston 742 to the pressure chamber 235 while preventing reverse flow.

Figure 11A:
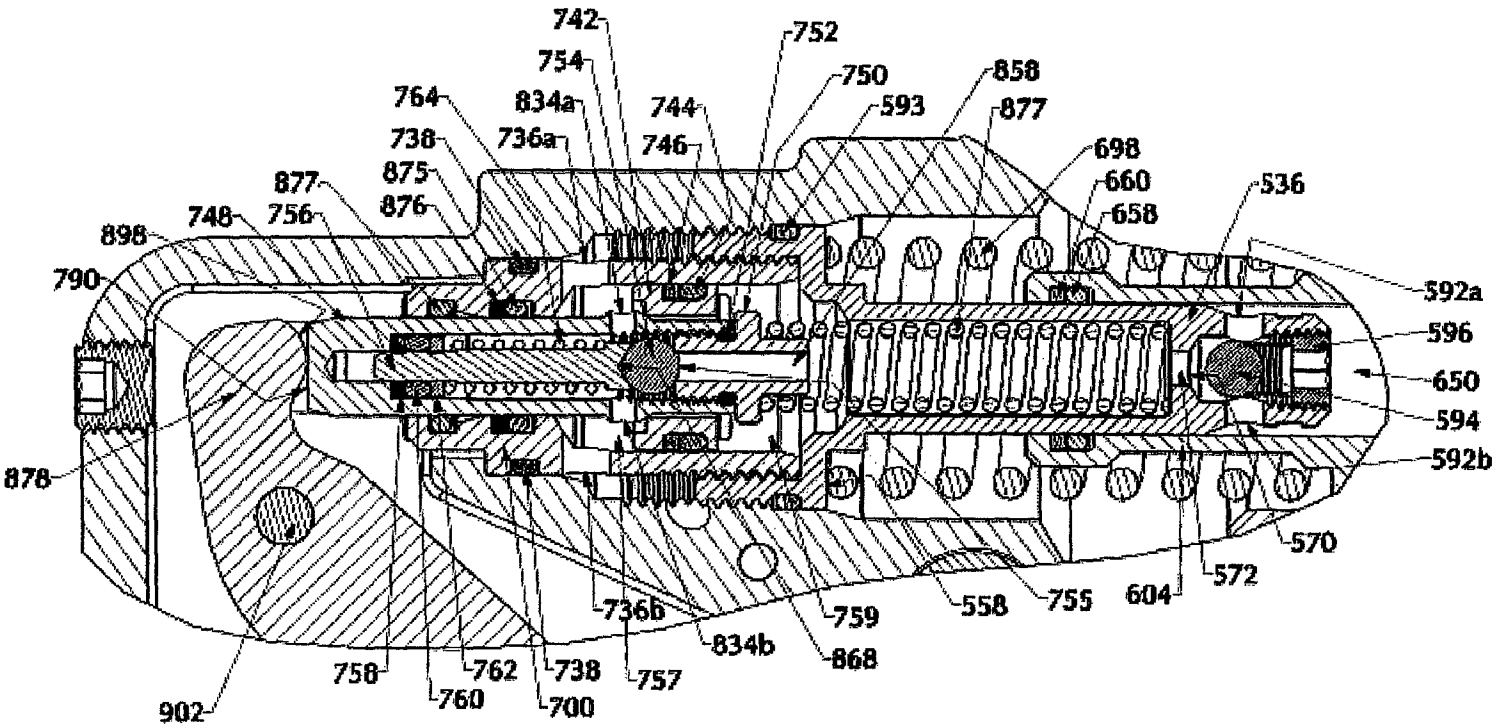
FIG. 11*a* is an enlarged view of FIG. 10 showing the hydraulic pump configuration in low pressure mode.
Figure 11B:
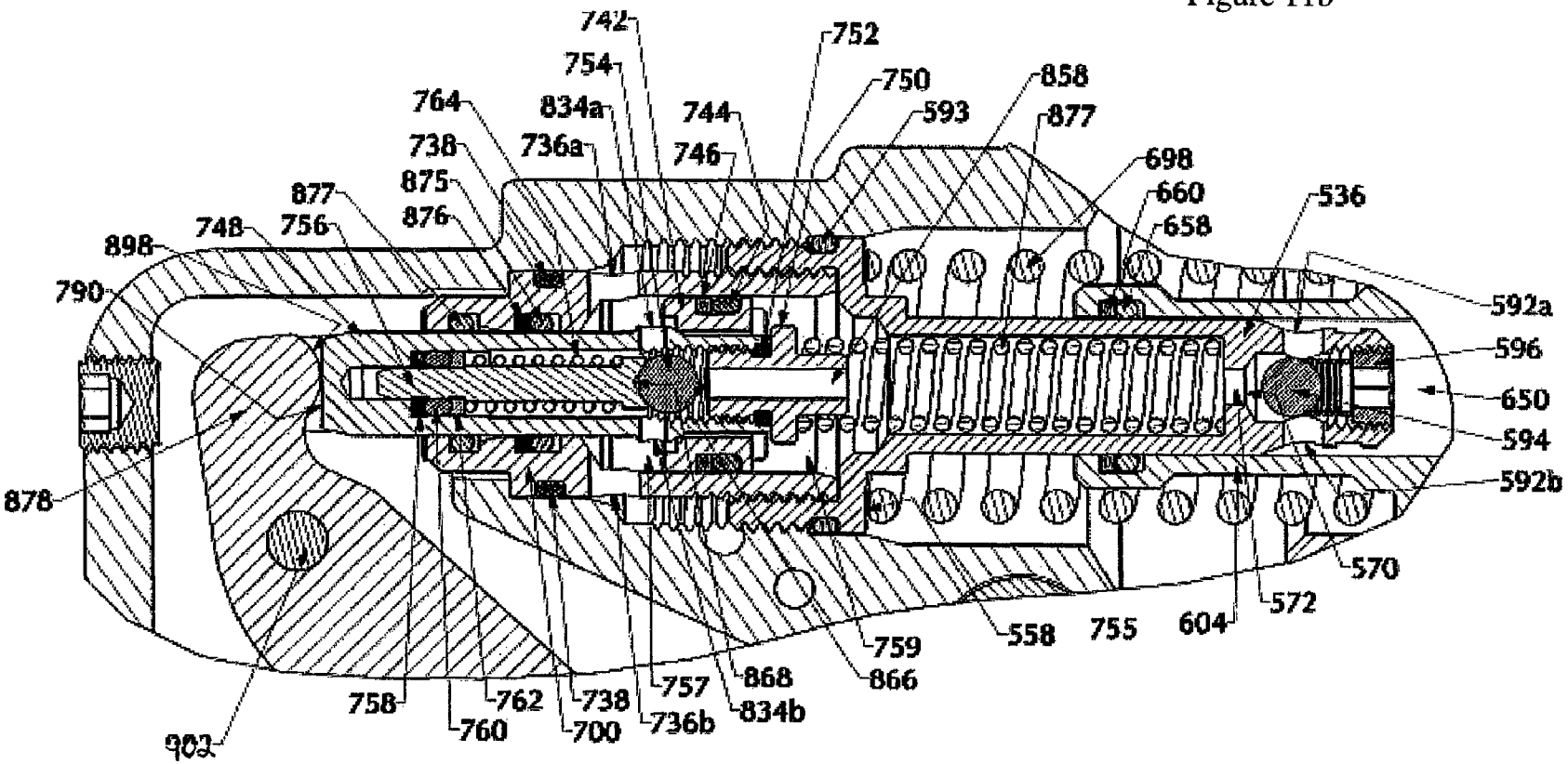
FIG. 11*b* is a partial cross sectional view of the tool taken along the line 4-4 showing hydraulic pump configuration in high pressure mode.

As best illustrated in FIG. 11*b* in a high pressure mode, the force pushing the pressure-sensitive valve 754 from the pressure chamber 759 of the hydraulic pump assembly 699 overcomes the compression spring 764 which allows the pressure-sensitive valve 754 to move away from the sealing edge 866 of piston cap 750 opening a path for the pressurized fluid to pass through the holes 834*a* and 834*b* in pump chamber 757 behind the pump piston 742. The pressure will then keep the plunger 756 pushed away from the pressure-sensitive valve 754 with a force equal to the area of the plunger 756 that is not compensated by pressure on the opposite side 869 of plunger 756. The pressure applied to both sides of the pump piston 742 cancel each other out, being equal in value but opposing each other. The area that now generates pressure is the difference between the front area of the pump piston 742 and the back area; the resulting area is about three times smaller. Considering that the operator will provide the same squeezing force, since pressure equals force over area, the pressure generated by this force will increase by a factor of three (3). Since the installation load cannot increase at such a sharp rate, this higher pressure mode will be felt by the operator as a significant decrease in hand effort.

Although the pump chamber 757 of hydraulic pump assembly 699 is connected to the reservoir 202 by the pathways 736*a*, 736*b*, 328, 308 and 276, the pressurized fluid is prevented from leaking to the reservoir 202 by the check valve 338 pushed into sealing edge 350 by the pressurized fluid. The check valve 338 shown in FIG. 6 allows the fluid to flow from pathway 308 through to pathway 328, and prevent fluid flow in opposite direction.

After squeezing the lever 878, the operator releases it, allowing it to return to its original position, away from the handle 111. This is achieved by the force that the compression spring 877 pushes on the right side of the piston cap 750, which in turn forces the pump piston 742 to move towards the left. The lever 878 swivels around the dowel pin 902 away from the handle 111 pushed by the face 790 of the pump piston 742.

Figure 12A:
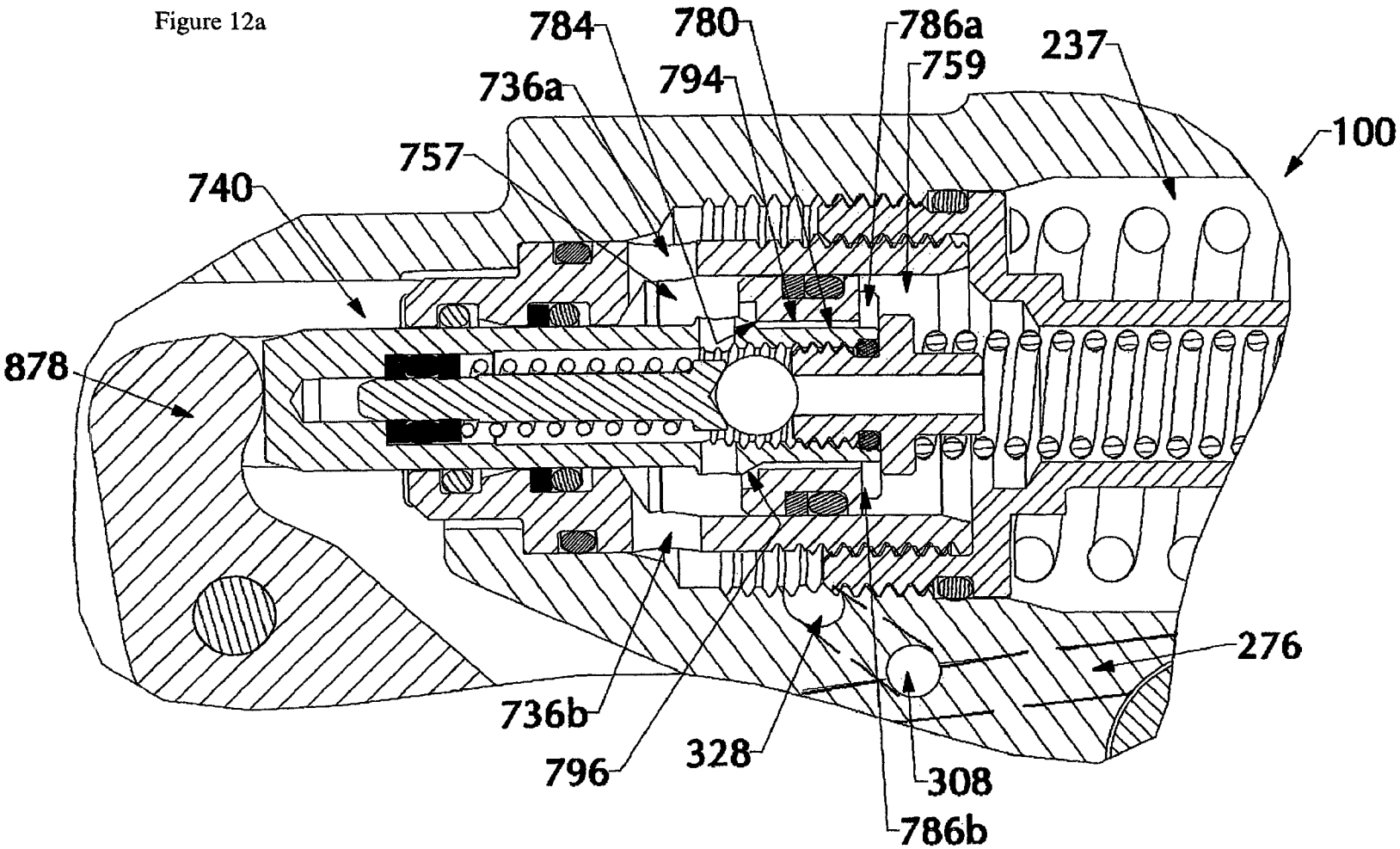
FIG. 12*a* is a partial cross sectional view of the tool taken along line 4-4 showing the pump piston configuration when lever 878 is released.
Figure 12B:
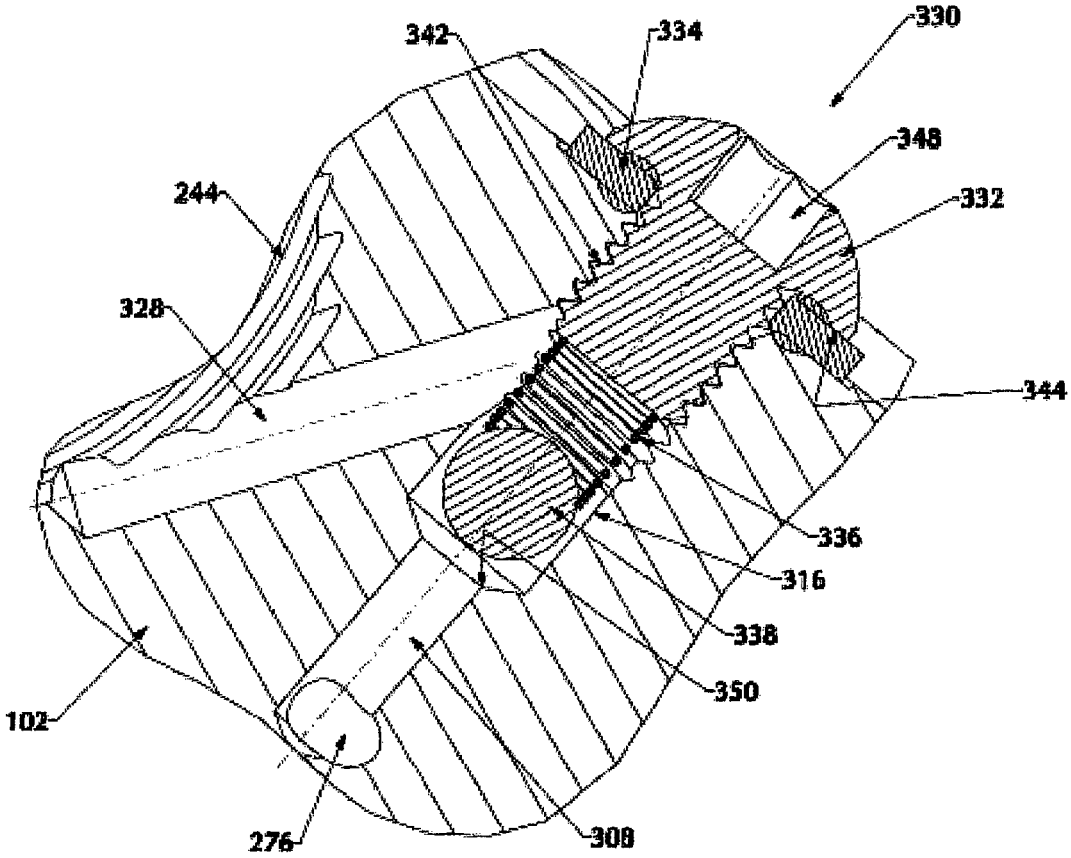
FIG. 12*b* is a partial cross sectional view of the tool illustrated in FIG. 2*b* taken along line 7-7 showing the check valve open when lever 878 is released.

As best illustrated in FIG. 12*a*, while the lever 878 is released and the pump piston rod 748 is pushed toward the left, the pump piston 742 will tend to lag behind because of O-Ring 744 and back-up ring 746. The tendency of pump piston 742 to resist will cause the tapered face 796 of pump piston rod 748 to move away from the sealing edge 784 of pump piston 742 opening a path for the fluid to flow between chambers 757, 759. Since all the pressurized fluid pumped ahead in the reservoir chamber 237 is prevented from flowing back into the pump chamber 759 by the check valve 594, the retraction of pump piston 742 which increases the volume of the right side of the hydraulic pump assembly 699, causes the pressure inside the hydraulic pump assembly 699 to fall under atmospheric pressure; this phenomenon will be referred to as suction pressure. Referring to FIG. 12*b* the pump suction pressure will cause the check valve 338 to unseat.

The pump chamber 757 is connected to the check valve cavity 316 via side openings 736*a* and 736*b* in pump housing 700 and the pathway 328 in the housing 102 allowing fluid from the reservoir chamber 237 to be drawn into the hydraulic pump assembly 699 via holes 320 and 326, 328, 736*a* and 736*b* until the pressure in the hydraulic pump assembly 699 equalizes the pressure in the reservoir chamber 237. When the operator squeezes the lever 878, the pressurized fluid pumped into the pressure chamber 235 will cause the piston 664 connected to piston rod 604 to be pushed backwards, away from adaptor 490, pulling the threaded end of the piston rod 604 with it inwardly into the tool 100. As shown in FIG. 14*a*, a drawbar 912 of a pulling head 911 which is threaded onto the piston rod 604 via adaptor 922, is forced away from the stationary nose piece 913 threaded into the sleeve 915 which in turn is mounted to the threaded portion 924 of the stationary front adaptor 490 of the tool 100.

As best illustrated in FIG. 14*a*, once the drawbar 912 is moved far enough from the conical end 936 of nosepiece 913, the tapered face 921 of jaws 914 will be pushed forward by the spring 918 and jaw follower 917 onto the internal tapered surface 919 of drawbar 912. This movement will cause them to close onto the stem 931 of fastener 930. As the pressure in chamber 235 increases, the stem 931 is pulled by the jaws 914 inside of the drawbar 912 through the stationary sleeve 934 of the fastener 930. In this low pressure mode, each squeeze of the lever 878 will cause a relatively long travel of the piston 664 with piston rod 604 and drawbar 912. The long travel per squeeze allows the operator to accomplish a certain displacement of the drawbar 912 pulling onto stem 931 of fastener 930 with a minimum number of squeezes. There are many types of blind fasteners; some are installed by pulling on the serrated stem 931, forming one or more bulbs on the blind side, locking the installed fastener by deforming a locking ring 935, then breaking the serrated stem 931 to complete the installation. Other blind fasteners are installed by flaring a sleeve 934 into an opening of work piece 933. There are also blind fasteners that install by a combination of flaring a sleeve and forming one or more bulbs on the blind side.

Figure 13:
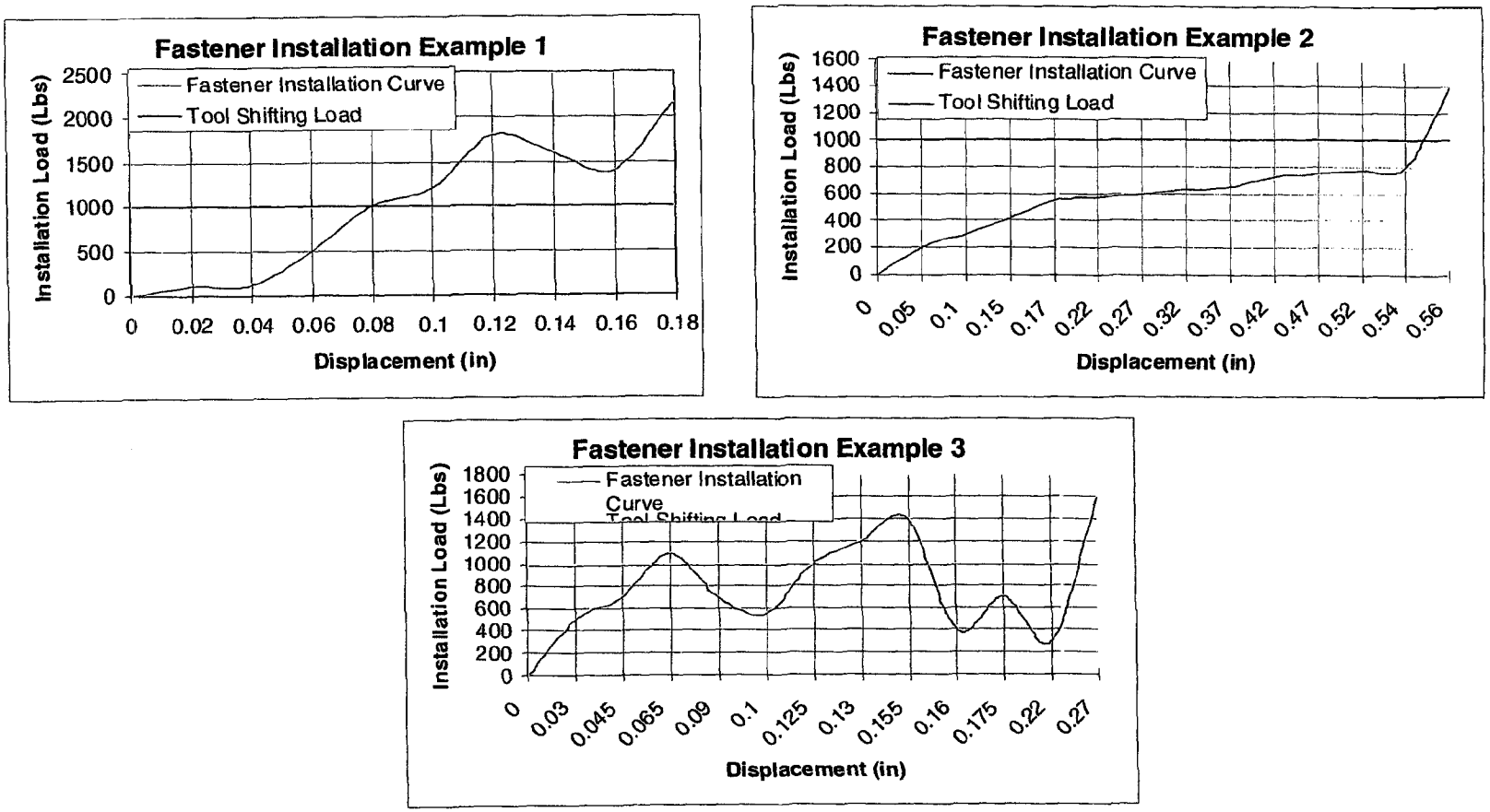
FIG. 13 illustrates three typical installation "Load vs. Deflection" diagrams showing examples of different blind fastener installation requirements.

In FIG. 13, there are three examples of installation curves for three different types of fasteners, as described above: a bulb type, a flaring (wiredraw) type and one installing by a combination of blind deformation and flaring. In line with the latest ergonomic requirements for this type of device hand effort up to 30 Lbs was selected as the shifting point to high pressure mode (significantly lower than the 55 Lbs effort required to shift in the tool described in U.S. Pat. No. 5,425,164); since a 30 Lbs hand effort results in an output load of around 1000 pounds at the threaded end of piston rod 604, this load is represented with a dashed line in the diagram. In example 1 the installation load vs. deflection are plotted in a diagram representative of a bulb type fastener sometime referred to as a blind bolt. The diagram shows the installation load increasing rapidly with a small dip before it peaks at the end of installation.

Example 2 shows the installation curve of a flaring type fastener, also referred to as wire draw rivets. Initially, the installation load increases as the stem 931 is pulled through stationary sleeve 934. After an initial load increase, the load stabilizes rising only slightly throughout the fastener installation; this type of fastener also tends to require long displacement and low installation load. The load peaks when the installation is completed.

Example 3 shows a fastener with a more complex installation curve. After an initial peak (above 1000 Lbs in the example) dips to about 600 Lbs, peaks again at 1400 Lbs and dips to about 200 Lbs before completing the fastener installation at around 1600 Lbs.

When installing a blind fastener with the tool 100, after a few squeezes of the lever 878 the pressure inside of the tool 100 increases to a level that would require such a high hand effort that could not be achieved by the operator even if using both hands. That is when the tool 100 switches to a high pressure mode, decreasing the hand effort required to squeeze the lever 878 and continue the fastener installation. The tool 100 will switch back to a low pressure mode after every squeeze of the lever 878, and only switches to a high pressure mode if required by the installation load. This way, the pressure-sensitive valve 754 is in fact a logical system, deciding which mode the tool 100 will operate each time the lever 878 is squeezed. This feature has proven to reduce the number of pumps significantly, achieving the seemingly impossible task of reducing the hand effort while decreasing the number of pumps. This will be referred throughout the remainder of the document as "smart mode shifting".

After the stem 931 has been pulled to a point where the fastener 930 is fully installed, the stem 931 breaks and the pressure in the system is manually relieved in order that piston 664 and piston rod 604 may return to their original state as shown in FIG. 3.

As best illustrated in FIG. 7*b*, to relieve the pressure, the operator will press on face 476 of the button 370 causing it to move toward the left side 274 of the tool 100. This causes the tapered sealing face 456 of valve poppet 358 to move away from the sealing edge 420 in valve body 354, opening a path for the pressurized fluid from pressure chamber 235 which is connected to the high pressure chamber 472 of pressure relief valve assembly 352 via pathway 306 in the housing 102 and side holes 424*a* and 424*b* of valve body 354 to flow to the reservoir chamber 237 via the low pressure chamber 474 of pressure relief valve assembly 352 and be relieved to the reservoir chamber 237 via side holes 422*a*, 422*b* of valve body 354 and 278 and 278 of the housing 102.

As best illustrated in FIG. 3, after relieving the pressure in pressure chamber 235 between piston 664 and front adaptor 490, the spring 698 expands causing the piston 664 with piston rod 604 to move toward the front adaptor 490. The movement of piston 664 will cause the unpressurized fluid in pressure chamber 235 to be pushed into the reservoir chamber 237 via the pressure relief valve following the path described above.

As best illustrated in FIG. 14*a*, the drawbar 912, including the jaws 914 and jaw follower 917, which is threaded into piston rod 604 is forced toward nose piece 913 and the front conical faces 925 of jaws 914 will open the jaws 914 when forced back and radially outwards by the conical diameter, releasing the broken fastener stem 931. The stem 931 will be pushed out of the pulling head 911 (ejected) by a stem stop 920 pushed by the compression spring 918 toward the nose piece 913.

Figure 16:
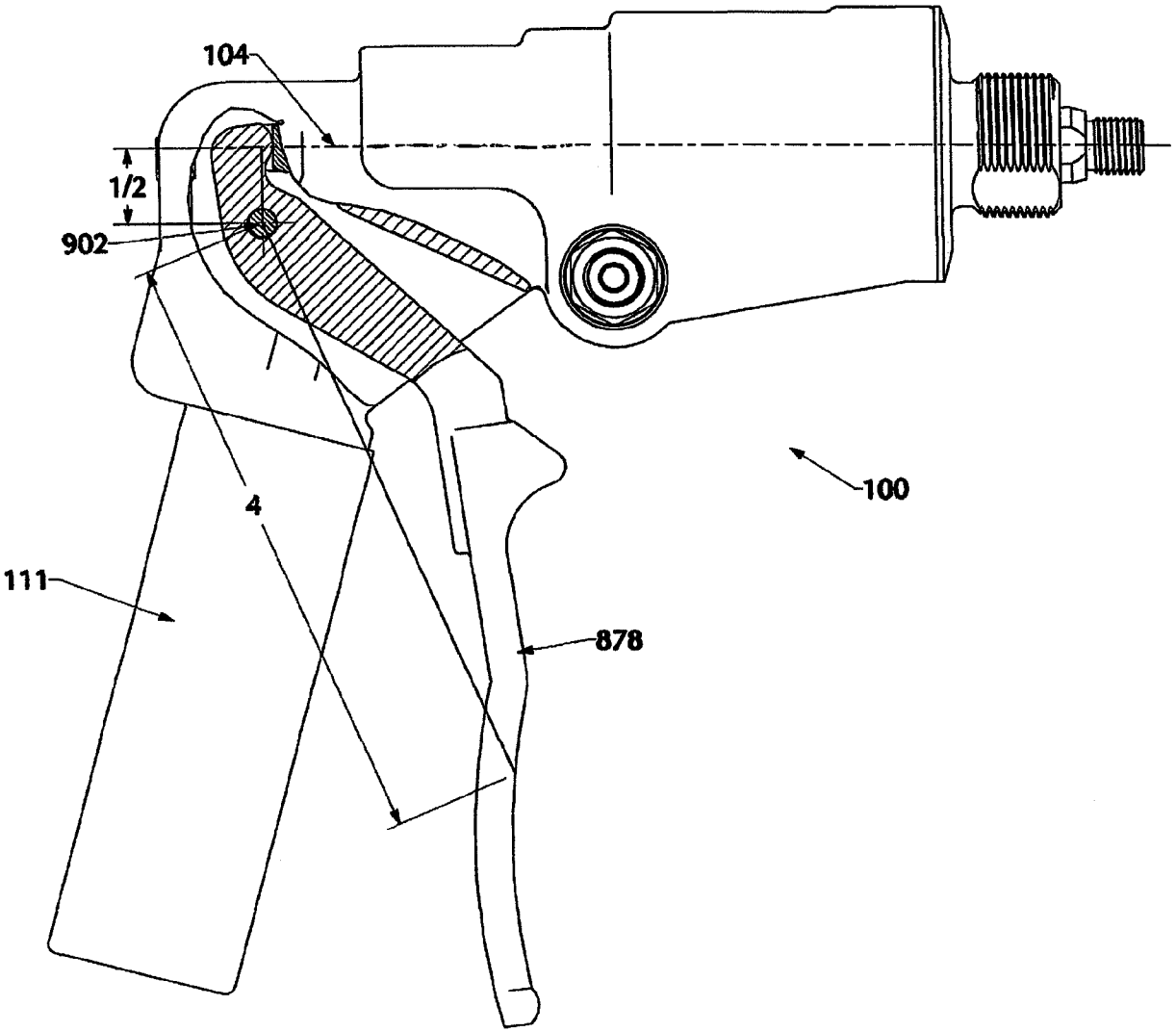
FIG. 16 is a view of the tool showing measurements at the lever 878.

As best illustrated in FIG. 16, it can be demonstrated that for a given force applied on lever 878, the force is multiplied by the lever swinging around the dowel pin 902 by a factor of 4/0.5=8. Therefore, the force pushing on the pump piston 742 via the lever 878 is eight times higher than the squeezing force. A comfortable ergonomic squeezing hand effort of 30 Lbs, therefore would produce a force of $F_{piston}$=30 Lbs× 8=240 Lbs on the pump piston 742. This force generates a fluid pressure $P=F_{piston}\times A1$ in the fluid in pump chamber 759 where A1 represents the total front area of the pump piston 742 and $F_{Piston}$ is the force on the piston of 240 Lbs computed earlier. In the disclosed embodiment, the diameter of the pump piston 742 is of 9/16, and A1 is 0.247 sq in. Therefore, the fluid pressure produced by a 30 Lbs squeezing force is P=240 Lbs/0.247 in=971 psi. When in high pressure mode, the pressure acting on both sides of the pump piston 742 is the same, cancelling each other, leaving only the uncompensated area A2 to produce fluid pressure according to the formula $P=F_{piston}\times A2$. In the disclosed embodiment the uncompensated diameter portion 802 of pump piston 742 is 0.332 in, and A2 is 0.087 producing a fluid pressure of P=240 Lbs/0.087 in=2758 psi. So the same comfortable hand effort of 30 Lbs will produce a fluid pressure of 971 psi in low pressure mode and 2758 psi in high pressure mode. This is desirable from the ergonomic standpoint to keep the hand effort within comfortable range while operating the tool. However, since part of the fluid being pumped is used to increase the pressure, a smaller amount of fluid is pumped through the check valve 594 in pressure chamber 235 with each squeeze of the lever 878 while in high pressure mode. Thus, if the tool 100 was built to only function in high pressure mode, an excessive number of squeezes would be necessary to install a fastener. The automatic mode shifting allows a minimum number of pumps when the installation load is not that high due to a faster movement of piston 664 with each squeeze of the lever 878, and a reduced hand effort when necessary but also an increased number of pumps when in high pressure mode as the installation load increases. This increased number of pumps in high pressure mode is acceptable since the hand effort is much more important, but not desired and needs to be kept to a minimum. Ergonomic research has also shown that the maximum hand strength achieved by an average person is around 50 to 60 Lbs at which the tool 100 disclosed in this document will achieve a pulling force of 5500 to 6000 Lbs at the threaded end 610 of piston rod 604. By comparison, the tool disclosed in U.S. Pat. No. 5,425,164 achieved about 3000-3800 Lbs for a 50 to 60 Lbs hand effort. In an installation example 1 of FIG. 13, it took the tool about three strokes to shift to higher pressure mode, completing the installation in four additional pumps. By contrast, if the tool 100 operated in high pressure mode it would have taken thirteen pumps. In example 3 of FIG. 13, it takes two pumps until the tool 100 shifts, three pumps in high pressure mode, three pumps back in low pressure mode and another three pumps in high pressure mode to complete the installation, a total of eleven pumps. By contrast, in this case it would have taken twenty-one pumps if it only operated in high pressure mode, and seventeen pumps for the tool described in U.S. Pat. No. 5,425,164.

As described earlier in this disclosure, the improvements in number of pumps have been accomplished at significantly lower hand effort. The significant improvements observed and described prove that the "smart mode shifting" mechanism disclosed here is very efficient. Obviously, in cases in which the installation load raises continuously, not allowing the tool 100 to take full advantage of its smart mode shifting, no significant gains will be observed in the number of pumps.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosed embodiments of the invention and does not pose a limitation on the scope of the invention unless otherwise claimed. No language in the specification should be construed as indicating any non-claimed element as essential to the practice of the invention. It is further to be understood that the drawings are not necessarily drawn to scale.

Preferred embodiments of this invention are described herein, including the best mode known to the inventor for carrying out the invention. It should be understood that the illustrated embodiments are exemplary only, and should not be taken as limiting the scope of the invention.

The invention is claimed as follows:

1. A tool comprising:

a fastener engaging assembly configured to set a fastener in a workpiece by having a first portion of said fastener engaging assembly grip and pull a stem of a fastener and having a second portion of said fastener engaging assembly hold a sleeve of the fastener in place;

a fluid reservoir; and a hydraulic operating assembly operably associated with said fastener engaging assembly, said hydraulic operating assembly being configured to cause said fastener engaging assembly to set the fastener in a workpiece upon pressurized fluid from said fluid reservoir being delivered to said hydraulic operating assembly, said hydraulic operating assembly being configured to automatically shift a mode of operation of said hydraulic pump assembly back and forth between a low pressure mode and a high pressure mode depending on an amount of installation load required for setting the fastener in the workpiece.

2. The tool as defined in claim 1, further comprising a manually actuated element which is operably associated with said hydraulic operating assembly, said manually actuated element being configured to provide a full fluid output with a given actuation of said element in order to deliver said pressurized fluid from said fluid reservoir to said hydraulic operating assembly, wherein when said hydraulic operating assembly is operating in said high pressure mode, higher output pressure may be generated by reduced manual effort on said element.

3. The tool as defined in claim 2, wherein said hydraulic operating assembly includes a pump piston and defines a pressure chamber forward of said pump piston and a pump chamber rearward of said pump piston, said pressurized fluid from said fluid reservoir being delivered to said pressure chamber.

4. The tool as defined in claim 3, wherein said hydraulic operating assembly is configured to redirect some of the pressurized fluid in said pressure chamber behind said pump piston and into said pump chamber when an internal fluid pressure in said pressure chamber exceeds a predetermined pressure, wherein said hydraulic operating assembly operates in said low pressure mode when said internal fluid pressure in said pressure chamber does not exceed said predetermined pressure, and wherein said hydraulic operating assembly operates in said high pressure mode when said internal fluid pressure in said pressure chamber exceeds said predetermined pressure, and wherein said pump piston is part of a pump piston assembly, said pump piston assembly further including a pressure sensitive valve, said pressure sensitive valve being in a closed position when said internal fluid pressure in said pressure chamber does not exceed said predetermined pressure, said pressure sensitive valve being in an open position when said internal fluid pressure in said pressure chamber exceeds said predetermined pressure.

5. The tool as defined in claim 4, wherein said pump piston includes a fluid passage configured to divert said pressurized fluid behind said pump piston to assist with the manual effort when said pressure sensitive valve is in said open position.

6. The tool as defined in claim 4, wherein said pump piston assembly further comprises a pump piston rod, wherein said pump piston rod has a tapered surface and wherein said pump piston has a sealing edge, said tapered surface configured to engage said sealing edge in order to seal said pressurized fluid ahead of said pump piston in said pressure chamber from said pump chamber when said element is actuated, and wherein when said element is released, said pump piston assembly is pushed back by a compression spring biased on said pump piston rod, thereby allowing said tapered surface to disengage from said sealing edge in order to allow said pressurized fluid ahead of said pump piston in said pressure chamber to move into said pump chamber.

7. The tool as defined in claim 6, further comprising a handle, said fluid reservoir having a first portion housed in said handle, a second portion in which said hydraulic operating assembly is housed, and at least one fluid passageway which connects said first portion to said second portion.

8. The tool as defined in claim 7, further comprising a check valve provided in said at least one fluid passageway, said check valve allowing fluid from said first portion of said fluid reservoir to flow to said second portion of said fluid reservoir in response to a sufficient pressure reduction in said pressure chamber, said check valve preventing fluid within said pressure chamber from flowing back into said first portion of said fluid reservoir via said at least one fluid passageway.

9. The tool as defined in claim 8, wherein a foam insulated sleeve surrounds said handle.

10. The tool as defined in claim 4, wherein said pump piston assembly is generally housed and movable within a stationary hydraulic pump assembly.

11. The tool as defined in claim 10, wherein said hydraulic pump assembly comprises a pump housing and a pump spring housing which are secured to one another, said movable pump piston assembly being at least partially positioned within said pump housing.

12. The tool as defined in claim 10, wherein said fastener engaging assembly includes a piston rod which is slidably and sealingly engaged with said stationary hydraulic pump assembly, said piston rod being normally forced away from said pump piston assembly by a spring which extends between said hydraulic pump assembly and said piston rod.

13. The tool as defined in claim 12, wherein a piston is operably associated with said piston rod and is configured to move back and forth within a portion of said fluid reservoir in conjunction with said piston rod, said piston defining a pressure chamber forward thereof.

14. The tool as defined in claim 13, wherein said pressure chamber defined within said pump piston assembly is in fluid communication with said pressure chamber defined forward of said piston via fluid passageways defined in said hydraulic pump assembly and said piston rod.

15. The tool as defined in claim 14, wherein a check valve is provided within said hydraulic pump assembly which allows fluid within said pressure chamber defined by said pump piston assembly to flow into said pressure chamber defined forward of said piston, but which prevents a reverse flow of said fluid.

16. The tool as defined in claim 1, further comprising a pressure relief valve assembly configured to automatically relieve an internal fluid pressure within said hydraulic operating assembly when said internal fluid pressure reaches a predetermined pressure, said pressure relief valve assembly being in fluid communication with said fluid reservoir and a pressure chamber defined by said hydraulic operating assembly, said pressure relief valve assembly allowing fluid within said pressure chamber to be returned to said fluid reservoir when said internal fluid pressure reaches said predetermined level.

17. The tool as defined in claim 16, wherein said pressure relief valve assembly is configured to be manually overridden.

18. The tool as defined in claim 16, wherein said pressure relief valve assembly comprises a button, a poppet, a valve body, a compression spring, and a pressure adjustment plug, said button being secured to said poppet, said poppet, said spring and said pressure adjustment plug being generally housed within said valve body, said spring being positioned between said pressure adjustment plug and said poppet in order to force said poppet into sealing engagement with said valve body.

19. The tool as defined in claim 18, wherein said pressure adjustment plug can be moved relative to said valve body in order to change a distance between said pressure adjustment plug and said poppet, thereby allowing for an adjustment of the amount of force exerted against said poppet.

20. A tool comprising:

a fastener engaging assembly configured to set a fastener in a workpiece by having a first portion of said fastener engaging assembly grip and pull a stem of a fastener and having a second portion of said fastener engaging assembly hold a sleeve of the fastener in place;

a fluid reservoir; and a hydraulic operating assembly operably associated with said fastener engaging assembly, said hydraulic operating assembly being configured to cause said fastener engaging assembly to set the fastener in a workpiece upon pressurized fluid from said fluid reservoir being delivered to said hydraulic operating assembly, said hydraulic operating assembly being configured to redirect pressurized fluid to a different location within said hydraulic operating assembly in order to aid said hydraulic operating assembly in causing said fastener engaging assembly to set the fastener in the workpiece.

* * * * *